US011654468B2

(12) United States Patent
Okada et al.

(10) Patent No.: US 11,654,468 B2
(45) Date of Patent: May 23, 2023

(54) ROLL BENDING APPARATUS

(71) Applicants: KAWASAKI JUKOGYO KABUSHIKI KAISHA, Kobe (JP); SANYO SEIKI CO. LTD., Asaka (JP)

(72) Inventors: Hideki Okada, Kakamigahara (JP); Akiyoshi Ono, Asaka (JP)

(73) Assignees: KAWASAKI JUKOGYO KABUSHIKI KAISHA, Kobe (JP); SANYO SEIKI CO. LTD., Asaka (JP)

( * ) Notice: Subject to any disclaimer, the term of this patent is extended or adjusted under 35 U.S.C. 154(b) by 0 days.

(21) Appl. No.: 17/404,636

(22) Filed: Aug. 17, 2021

(65) Prior Publication Data

US 2021/0370375 A1 Dec. 2, 2021

Related U.S. Application Data

(63) Continuation of application No. 16/084,886, filed as application No. PCT/JP2017/010732 on Mar. 16, 2017, now abandoned.

(Continued)

(51) Int. Cl.

| | |
|---|---|
| ***B21D 7/00*** | (2006.01) |
| ***B21D 7/08*** | (2006.01) |
| ***B21D 5/08*** | (2006.01) |
| ***B21D 7/14*** | (2006.01) |
| ***B21D 7/16*** | (2006.01) |

(52) U.S. Cl.

CPC ..... *B21D 7/08* (2013.01); *B21D 5/08* (2013.01); *B21D 7/14* (2013.01); *B21D 7/16* (2013.01)

(58) Field of Classification Search

CPC . B21D 5/14; B21D 5/083; B21D 7/08; B21D 37/04; B21D 5/08

See application file for complete search history.

(56) References Cited

U.S. PATENT DOCUMENTS 3,268,985 A 8/1966 Smith
2015/0027641 A1* 1/2015 Lee ..... B21D 5/08 72/182

FOREIGN PATENT DOCUMENTS

JP 2004-130383 A 4/2004
JP 2011-516275 A 5/2011

(Continued)

OTHER PUBLICATIONS

Jun. 6, 2017 Search Report issued in International Patent Application No. PCT/JP2017/010732.

(Continued)

*Primary Examiner* — Debra M Sullivan
(74) *Attorney, Agent, or Firm* — Oliff PLC

(57) ABSTRACT

A roll bending apparatus includes: a roll pair formed by a pair of rolls disposed facing each other, the roll pair being configured to sandwich an elongated material between the rolls to perform forming on the elongated material; a slide mechanism configured to slide the roll pair in a first normal direction that is a direction normal to a conveying direction of the elongated material on a plane including the conveying direction; and a tilt mechanism configured to rotate the roll pair about a tilt axis that extends in a second normal direction that is a direction orthogonal to the conveying direction and the first normal direction. The slide mechanism further slides the roll pair to change a position of the roll pair relative to the tilt axis.

6 Claims, 18 Drawing Sheets

Related U.S. Application Data

(60) Provisional application No. 62/309,499, filed on Mar. 17, 2016.

(56) References Cited

FOREIGN PATENT DOCUMENTS

| | | | |
|---|---|---|---|
| JP | 5122863 | B2 | 1/2013 |
| WO | 2006/138179 | A2 | 12/2006 |
| WO | 2009/126677 | A2 | 10/2009 |

OTHER PUBLICATIONS

Oct. 6, 2020 U.S. Office Action issued U.S. Appl. No. 16/084,886.

* cited by examiner

ROLL BENDING APPARATUS

This is a continuation application of U.S. patent application Ser. No. 16/084,886, filed Sep. 13, 2018, which is a national stage entry of PCT/JP2017/010732 filed Mar. 16, 2017, which in turn claims priority to U.S. Patent Application No. 62/309,499, filed Mar. 17, 2016. The disclosures of each of the above are hereby incorporated by reference in their entireties.

TECHNICAL FIELD

The present invention relates to a roll bending apparatus capable of precisely forming a curve in an elongated component that has a varying contour or varying cross-sectional rigidity.

BACKGROUND ART

For example, in roll bending for forming a curve in an elongated formed component (an elongated component or elongated member) such as an aircraft frame, the optimal position (optimal angle) of a bending roll is uniquely determined based on various conditions, such as the width of the elongated component, the type of the material of the elongated component, and the contour of the elongated component. Therefore, a roll bending apparatus to be used in the roll bending is prepared by taking account of the conditions of the elongated component to be manufactured.

There are various types of elongated components, such as not only one having an overall uniform cross section in the longitudinal direction, but also one having a cross-sectional shape that varies at different portions thereof (i.e., one having a flexible cross-sectional shape). Hereinafter, for the sake of convenience of the description, such an elongated component having a flexible cross-sectional shape is referred to as "flexible cross-sectional elongated component", and also, an elongated component having an overall uniform cross section in the longitudinal direction is referred to as "uniform cross-sectional elongated component". Conventionally, for example, press forming using a mold has been known as a method of forming a flexible cross-sectional elongated component. In recent years, a roll forming apparatus capable of forming a flexible cross-sectional elongated component without using a mold has been proposed.

For example, Patent Literature 1 discloses a roll forming apparatus configured to follow a plate member (a blank) that has been pre-formed to have an intended contour and capable of controlling, for example, the driving speed of a bending roll. Patent Literature 2 discloses a roll forming apparatus capable of shifting the roll position in a direction orthogonal to the feeding direction, and continuously changing the inclination angle of the roll axis relative to the feeding direction.

Among uniform cross-sectional elongated components, there is such an elongated component that the degree of a curve formed therein partly varies. Such an elongated component is hereinafter referred to as "flexible curve elongated component" for the sake of convenience of the description. There are known apparatuses for forming such an elongated component, for example, a stretch forming apparatus using a mold or a roll bending apparatus. For example, Patent Literature 3 discloses a known roll bending apparatus including a sweep station that moves a bottom roller relative to a top roller along an arc-shaped path to a new position downstream of the top roller, and thereby a plurality of sweeps (i.e., a non-uniform curve in the longitudinal direction) are given to a continuous beam (an elongated component).

CITATION LIST

Patent Literature

PTL 1: Japanese Laid-Open Patent Application Publication No. 2004-130383

PTL 2: Japanese Patent No. 5122863

PTL 3: WO2006/138179

SUMMARY OF INVENTION

Technical Problem

Generally speaking, in the case of forming an elongated component whose curve in the longitudinal direction (i.e., contour) varies, or forming an elongated component whose bending rigidity varies due to its shape, material, etc., by using a roll bending apparatus, it is necessary to greatly change the path line of the elongated component. It is also known that a general roll bending apparatus includes a slide mechanism formed by a ball screw or the like as a mechanism for adjusting the roll position. Such a conventional slide mechanism is intended for performing fine roll setting adjustments when bending an elongated component having a constant cross section.

Therefore, when forming a flexible curve elongated component, it is conceivable to make, for example, position adjustments by sequentially moving the roll position in a sliding manner by the aforementioned general slide mechanism so as to conform to the change in the path line.

However, for example, in the case of an elongated member having a wide cross section such as an aircraft member, if a roll is disposed on only one side of the member, bending the member in a manner to keep its proper cross section cannot be performed. Therefore, it is required to dispose rolls on both sides of the elongated member (i.e., pinch type) when performing the bending. In this case, it is substantially difficult, by merely sliding these rolls, to adjust the position of the roll set (the pair of rolls facing each other) such that the roll set is positioned orthogonally to the tangent line to the path line. Unless the roll set is orthogonal to the path line, it is difficult to properly form an elongated component. Therefore, in accordance with the change in the path line, the entire roll set (including the base of the rolls) needs to be replaced. Such replacement of the roll set is necessary even when the cross-sectional shape of the elongated component varies just slightly (e.g., by about 0.5 mm).

It is also known that a roll forming apparatus for forming a flexible cross-sectional elongated component includes a tilt mechanism for tilting the rolls when forming a cross section that varies in the longitudinal direction. Also for bending a flexible curve elongated member, it is conceivable to perform position adjustments of the rolls by the tilt mechanism. However, even if such a configuration is adopted, it is still difficult to adjust the roll position so as to sufficiently conform to the change in the path line.

When forming a flexible curve elongated component, it is also conceivable to use a sweep mechanism to form a flexible curve in a manner similar to the roll bending apparatus disclosed by Patent Literature 3. However, even if such a configuration is adopted, it is still difficult to form a shape in which the curvature varies continuously.

Generally speaking, in roll bending, even if substantially the same curve is to be formed in elongated components that have the same cross-sectional shape, the amount by which the rolls are slid (i.e., the amount of roll position adjustment made by sliding the rolls) may be significantly different between the elongated components depending on the material of each elongated component. The reason for this is that the amount of spring-back of each material varies due to their differences in terms of, for example, Young's modulus or 0.2% proof stress. Therefore, the amount of tilt of the rolls, or the amount of slide of the rolls, needs to be changed for each material.

The present invention has been made to solve the above-described problems. An object of the present invention is to provide a roll bending apparatus for bending an elongated component having a varying contour or varying cross-sectional rigidity, the apparatus being configured such that rolls are disposed on both sides of the elongated component (i.e., pinch type), the apparatus being capable of properly forming a curve in the elongated component without requiring, for example, replacement of the rolls.

Solution to Problem

In order to solve the above-described problems, a roll bending apparatus according to the present invention includes: a roll pair formed by a pair of rolls disposed facing each other, the roll pair being configured to sandwich an elongated material between the rolls to perform forming on the elongated material; a slide mechanism configured to slide the roll pair in a first normal direction that is a direction normal to a conveying direction of the elongated material on a plane including the conveying direction; and a tilt mechanism configured to rotate the roll pair about a tilt axis that extends in a second normal direction that is a direction orthogonal to the conveying direction and the normal direction. The slide mechanism is configured to further slide the roll pair to change a position of the roll pair relative to the tilt axis.

According to the above configuration, since the roll bending apparatus includes the slide mechanism and the tilt mechanism, not only is the roll pair simply slid, but also the position of the roll pair can be changed relative to the tilt axis. This makes it possible to adjust the position of the roll pair such that the roll pair is positioned orthogonally to the tangent line to a path line. This consequently makes it possible to perform roll bending with a different path line. Therefore, even if the single elongated component has a varying contour or varying cross-sectional rigidity within itself, a curve can be formed therein precisely. As a result, the elongated component having a varying contour or varying cross-sectional rigidity can be manufactured without using, for example, stretch forming or press forming.

In addition, in the case of forming a predefined cross-sectional shape by roll forming and/or roll bending, a curve can be formed by roll bending continuously following the roll forming of forming the cross-sectional shape. Therefore, the elongated component can be manufactured by using substantially continuous equipment (jig and/or rolls). This makes it possible to realize significant cost reduction.

In the roll bending apparatus configured as above, the slide mechanism may be configured to include: a first slide part configured to slide at least the tilt mechanism and the roll pair collectively in the first normal direction; and a second slide part configured to slide the roll pair in the first normal direction to change the position of the roll pair relative to the tilt axis.

In the roll bending apparatus configured as above, the slide mechanism may be configured to further include a third slide part configured to slide at least one of the rolls forming the roll pair in the first normal direction to change a gap between the rolls.

The roll bending apparatus configured as above may include a roll drive unit configured to drive each of the rolls to rotate, and the roll drive unit may be configured to be attachable to and detachable from the rolls.

The roll bending apparatus configured as above may include a plurality of forming roll parts each including the roll pair, the plurality of forming roll parts being arranged in the conveying direction of the elongated material. At least one of the forming roll parts may be configured to include the slide mechanism and the tilt mechanism.

In the roll bending apparatus configured as above, the forming roll parts may include: a cross-sectional-shape-forming roll bending part configured to roll-form an elongated plate member that is the elongated material into an elongated component having a predefined cross-sectional shape; and a curve-forming forming roll part configured to form a curve in the elongated component that is the elongated material. The curve-forming forming roll part may be provided with the slide mechanism and the tilt mechanism.

The above and other objects, features, and advantages of the present invention will more fully be apparent from the following detailed description of a preferred embodiment with accompanying drawings.

Advantageous Effects of Invention

With the above-described configuration, the present invention produces an advantageous effect of being able to provide a roll bending apparatus for bending an elongated component having a varying contour or varying cross-sectional rigidity, the apparatus being configured such that rolls are disposed on both sides of the elongated component (i.e., pinch type), the apparatus being capable of properly forming a curve in the elongated component without requiring, for example, replacement of the rolls.

DESCRIPTION OF EMBODIMENTS

Figure 1A:
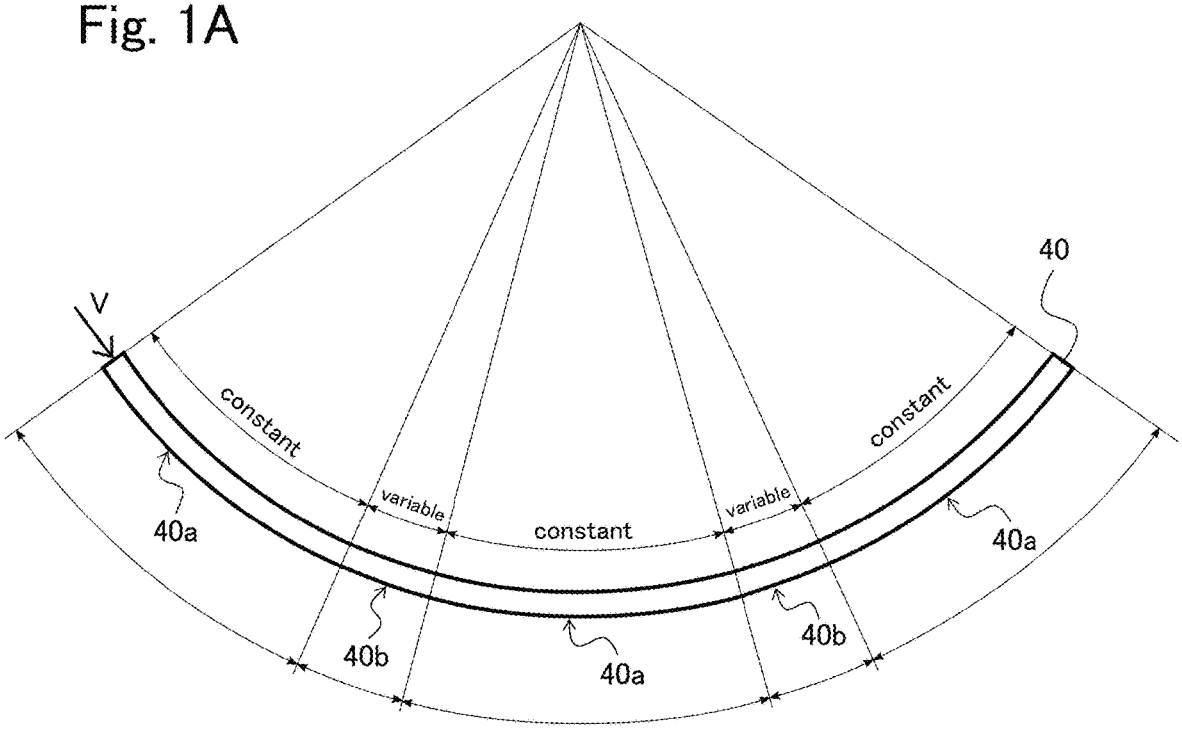
FIG. 1A is a plan view showing one typical example of an elongated component manufactured by a roll bending apparatus according to one embodiment of the present disclosure.

Hereinafter, a typical embodiment of the present invention is described with reference to the drawings. In the drawings, the same or corresponding elements are denoted by the same reference signs, and repeating the same descriptions is avoided below.

Elongated Component

First, one typical example of an elongated formed component (elongated component) manufactured according to the present disclosure is specifically described with reference to FIGS. 1A to 1E.

In the present embodiment, among various structural members used in manufacturing of an aircraft fuselage, a frame used in the cross-sectional direction (lateral direction) of the aircraft fuselage as shown in FIG. 1A is taken as one example of an elongated component 40. The elongated component 40 (frame) has a curved shape as a whole. Both end portions and the central portion of the elongated component 40 in the longitudinal direction (the lengthwise direction of the elongated component 40) are constant curve portions 40*a*, each of which is curved with a constant curvature. The portions positioned between the constant curve portions 40*a* are variable curve portions 40*b*, each of which is curved with a curvature that is different from the curvature of the constant curve portions 40*a*. Thus, the elongated component 40 has a varying contour.

The cross-sectional shape of the elongated component 40 shown in FIG. 1A is not particularly limited, but may be a predefined shape set in advance. For example, as shown in FIGS. 1B to 1E, one of or both the edges of the elongated component 40 in the cross-sectional direction (the lateral direction of the elongated component 40) may be bent. It should be noted that each of FIGS. 1B to 1E is a view of one end face of the elongated component 40 of FIG. 1A as seen in the direction of an arrow V of FIG. 1A. The shape of the end face substantially corresponds to the cross-sectional shape of the elongated component 40. Thus, the elongated component 40 can be regarded as a component having a cross section that is uniform overall in the longitudinal direction but having a varying contour (i.e., a uniform cross-sectional elongated component).

Figure 1B:
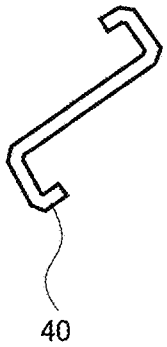
FIGS. 1B to 1E are end views each showing one example of the shape of the elongated component of FIG. 1A as seen in the direction of an arrow V.
Figure 1C:
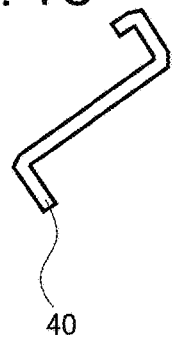

Each of the cross-sectional shapes shown in FIG. 1B and FIG. 1C is a Z shape (i.e., Z-shaped), such that both the edges in the cross-sectional direction are bent. In the cross-sectional shape shown in FIG. 1B, the outer portions of both the bent edges are further bent, whereas in the cross-sectional shape shown in FIG. 1C, the outer portion of only one of the bent edges (in FIG. 1C, the outer portion of the upper bent edge) is further bent.

Figure 1D:
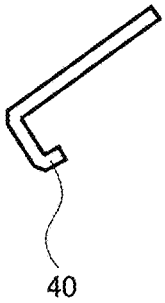
Figure 1E:
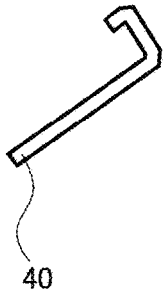

Each of the cross-sectional shapes shown in FIG. 1D and FIG. 1E is an L shape (i.e., L-shaped), such that one of the edges in the cross-sectional direction is bent. In the cross-sectional shape shown in FIG. 1D, only the lower edge is bent, whereas in the cross-sectional shape shown in FIG. 1E, only the upper edge is bent. In each of the cross-sectional shapes shown in FIG. 1D and FIG. 1E, the outer portion of the bent edge is further bent.

It should be noted that the cross-sectional shape of the elongated component 40 manufactured according to the present disclosure is not limited to the shapes shown in FIGS. 1B to 1E, but may be any known shape. Other than the Z shape (see FIG. 1B or FIG. 1C) or the L shape (see FIG. 1D or FIG. 1E), the cross-sectional shape of the elongated component 40 may be, for example, a J shape or a hat shape.

The elongated component 40 shown in FIG. 1A is a uniform cross-sectional elongated component as mentioned above. However, the elongated component 40 manufactured according to the present disclosure is not thus limited, but may be an elongated component whose cross-sectional shape varies at different portions thereof in the longitudinal direction (i.e., may be a flexible cross-sectional elongated component having a flexible cross-sectional shape). The material of the elongated component 40 is not particularly limited. In a case where the elongated component 40 is an aircraft component such as a frame, the material of the elongated component 40 is, for example, aluminum or an alloy thereof (an aluminum-based material). In a case where the elongated component 40 is a component used in a different field, the material of the elongated component 40 is, for example, a ferrous material (iron or an alloy containing iron), such as steel.

In a case where the elongated component 40 has a flexible cross-sectional shape, the elongated component 40 may have a varying cross-sectional rigidity depending on its cross-sectional shape. Moreover, in the case of forming the same curve in elongated components 40 having the same shape by using the same roll bending apparatus, if the materials of the elongated components 40 are different from each other, then the cross-sectional rigidities of the elongated components 40 are different from each other even though the same curve is formed in the elongated components 40 having the same shape. The difference between the materials is, for example, a difference in terms of a metal material serving as a main component, such as a difference between an aluminum-based material and a ferrous material. Furthermore, even among a plurality of alloy materials each categorized as an aluminum-based material, their cross-sectional rigidities may be different from each other depending on, for example, the types of the alloys. The elongated component 40 manufactured according to the present disclosure may be an elongated component having such a varying cross-sectional rigidity.

It should be noted that in a case where the elongated component 40 is an aircraft component, the elongated component 40 is not limited to a frame. Specific examples of the elongated component 40 include a stringer, stiffener, spar, floor beam, rib, frame, and a doubler. Although these are aircraft structural members, the elongated component 40 is not limited to such a structural member, but may be a different aircraft component. Additionally, the elongated component 40 manufactured according to the present disclosure is not limited to an aircraft component, but may be suitably used as a curved component in other fields, such as in the field of automobiles or building materials.

In the description of the roll bending apparatus below, as one typical example, a curve is formed in (i.e., a curve is imparted to) a component that has been pre-formed to have a predefined cross-sectional shape, and thereby the elongated component 40 is manufactured. However, the present disclosure is not thus limited. Alternatively, a plate member that has not been pre-formed to have a cross-sectional shape may undergo a process in which the plate member is formed to have a predefined cross-sectional shape, the process being continuously followed by another process in which a curve is formed in the plate member. In the present disclosure, if the "elongated component 40" as shown in FIG. 1A is defined as a "component (or member) with a curve formed therein", then a "component (or member) with no curve formed therein yet" is referred to as an "elongated material" for the sake of convenience of the description.

The definition of the "elongated material" includes an elongated material that has been formed to have a cross-sectional shape but has no curve formed therein yet, and also includes, for example, a plate member that has no cross-sectional shape and no curve formed therein yet. In addition, if the elongated component 40 is defined as a component on which any known machining has been performed in addition to the cross-sectional shape forming and the curve forming, then the definition of the "elongated material" includes not only a plate member on which no machining has been performed yet (or a raw material), but also a member on which the machining except the curve forming has been performed. The cross-sectional shape forming or the other machining may be performed by a known method. In particular, the cross-sectional shape forming as well as the curve forming in the present disclosure can be performed by known roll forming.

Fundamental Configuration of Roll Bending Apparatus

Next, one typical example of the roll bending apparatus according to the present disclosure is specifically described with reference to FIG. 2A and FIG. 2B.

The roll bending apparatus according to the present disclosure may include: a slide mechanism configured to slide a roll pair in a normal direction to a conveying direction of an elongated material on a plane including the conveying direction; and a tilt mechanism configured to rotate the roll pair about a tilt axis that extends in a direction orthogonal to each of the conveying direction and the normal direction. The slide mechanism may be further configured to slide the roll pair to change the position of the roll pair relative to the tilt axis.

It should be noted that, in the present embodiment, the conveying direction in which the elongated material is conveyed by the roll pair is simply referred to as "conveying direction". As previously described, the direction in which the slide mechanism is slid is "a normal direction to a conveying direction of an elongated material on a plane including the conveying direction", whereas the direction of the tilt axis about which the slide mechanism is rotated is "a direction orthogonal to each of the conveying direction and the normal direction", i.e., "a normal direction to a plane (conveying plane) including the conveying direction and the normal direction". Accordingly, in the present embodiment, for the sake of convenience of the description, the direction of the sliding movement is referred to as "first normal direction", and the direction of the tilt axis is referred to as "second normal direction".

Figure 2A:
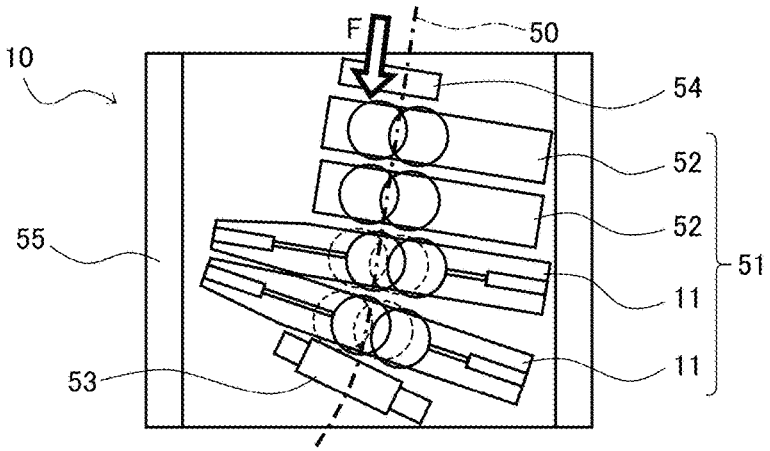
FIG. 2A is a schematic top view showing a typical configuration of the roll bending apparatus according to the embodiment of the present disclosure.
Figure 2B:
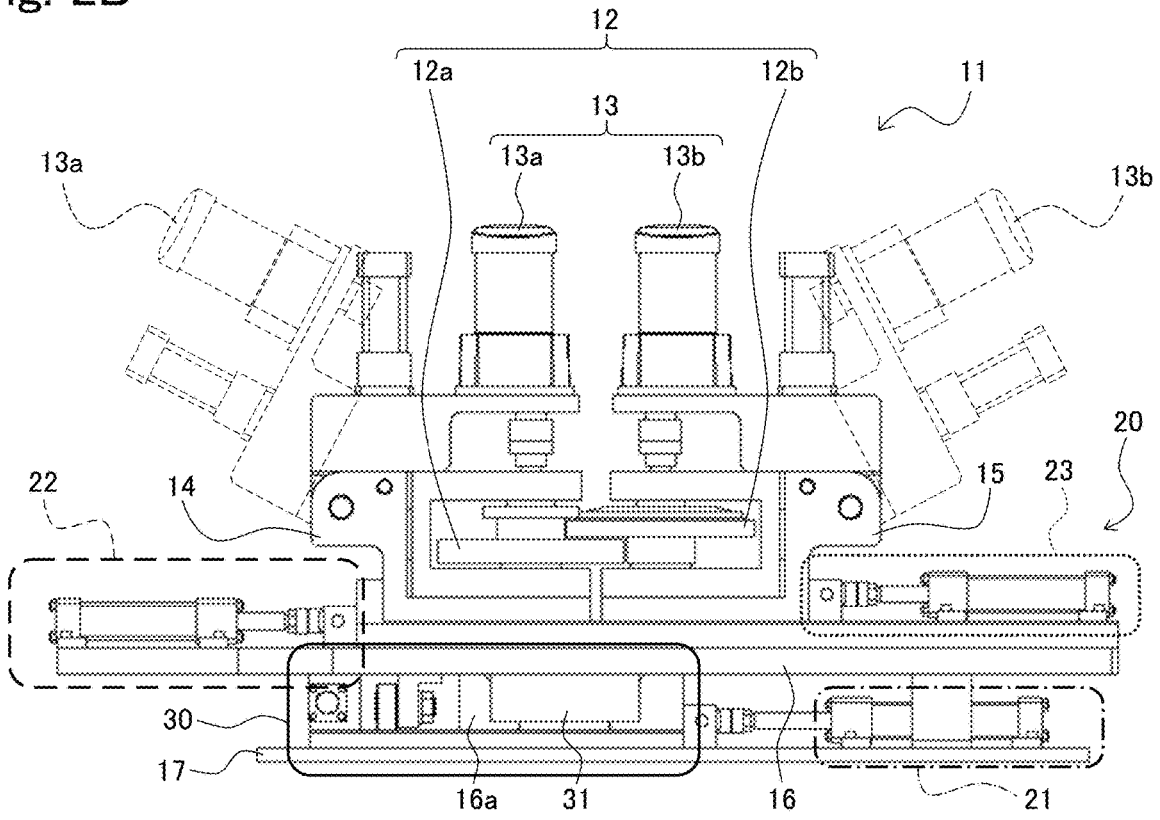
FIG. 2B is a front view showing a typical configuration of a forming roll part included in the roll bending apparatus of FIG. 2A.

One example of the roll bending apparatus with the above-described configuration is a roll bending apparatus 10 configured as shown in FIG. 2A and FIG. 2B. As shown in FIG. 2A, the roll bending apparatus 10 according to the present embodiment includes, for example, a plurality of (four in the example of FIG. 2A) roll bending parts 51, a pulling stand 53, a measuring roll part 54, and a bending apparatus base 55. The plurality of roll bending parts 51, the pulling stand 53, and the measuring roll part 54 are arranged along a bending path 50 represented by one-dot chain line in FIG. 2A, and these components are installed on the bending apparatus base 55. It should be noted that a block arrow F in FIG. 2A indicates the conveying direction of an elongated material that is not shown.

In the configuration shown in FIG. 2A, the roll bending apparatus 10 includes, as the plurality of roll bending parts 51, curve-forming (roll-bending) forming roll parts 11 and cross-sectional-shape-forming (roll-forming) roll bending parts 52. When seen in the conveying direction F from the upstream side, the pulling stand 53, the two roll bending parts 52, the two forming roll parts 11, and the measuring roll part 54 are arranged in this order on the bending path 50.

The roll bending parts 52 form a predefined cross-sectional shape of an elongated material that is not shown. The forming roll parts 11, as described below, form a curve in the elongated material (or component) that has been formed to have the cross-sectional shape, thereby forming the elongated material (or component) into an elongated component 40. The pulling stand 53 pulls the elongated material in the conveying direction F. The measuring roll part 54 measures the length of the elongated material. It should be noted that specific configurations of the roll bending parts 52, the pulling stand 53, the measuring roll part 54, and the bending apparatus base 55 are not particularly limited, and known configurations are suitably applicable thereto. The roll bending apparatus 10 may include other components in addition to the plurality of roll bending parts 51, the pulling stand 53, the measuring roll part 54, and the bending apparatus base 55.

As shown in FIG. 2B, each forming roll part 11 includes, for example, a roll pair 12, a roll drive unit 13, a first roll support 14, a second roll support 15, a roll pair support 16, a stand base 17, a slide mechanism 20, and a tilt mechanism 30. The roll pair 12 is formed by a pair of rolls 12*a* and 12*b*.

Looking at FIG. 2B, the left one of the pair of rolls 12*a* and 12*b* is referred to as a first roll 12*a*, and the right one of the pair of rolls 12*a* and 12*b* is referred to as a second roll 12*b*. The first roll 12*a* includes an upper smaller-diameter portion and a lower larger-diameter portion. The second roll 12*b* includes an upper larger-diameter portion and a lower smaller-diameter portion. The outer peripheral surface of the smaller-diameter portion of the first roll 12*a* faces the outer peripheral surface of the larger-diameter portion of the second roll 12*b*, and the outer peripheral surface of the larger-diameter portion of the first roll 12*a* faces the outer peripheral surface of the smaller-diameter portion of the second roll 12*b*. Each of the smaller-diameter portion and the larger-diameter portion of the first roll 12*a* and the larger-diameter portion and the smaller-diameter portion of the second roll 12*b* has substantially the same outer peripheral surface width (i.e., each of the roll portions has substantially the same width or height).

Above the smaller-diameter portion of the first roll 12*a*, an intermediate-diameter portion is provided, the width of which is less than the width of the smaller-diameter portion or the larger-diameter portion. The intermediate-diameter portion faces the peripheral edge of the upper surface of the larger-diameter portion of the second roll 12*b*. Since the first roll 12*a* and the second roll 12*b* are arranged so as to face each other in such a state, a substantially Z-shaped gap is formed between the roll pair 12. Accordingly, in the present embodiment, an elongated material fed into the forming roll part 11 is required to be a component having a Z-shaped cross section. To be more specific, the elongated material may have such a cross-sectional shape as shown in FIG. 1C, in which the outer portion of only one of the bent edges is further bent.

The roll pair 12 is driven by the roll drive unit 13 to rotate. In the present embodiment, the roll drive unit 13 is formed by a first roll driver 13*a* and a second roll driver 13*b*. The first roll driver 13*a* is positioned above the first roll 12*a*, supports the upper end of the roll shaft of the first roll 12*a*, and drives the first roll 12*a* to rotate. The second roll driver 13*b* is positioned above the second roll 12*b*, supports the upper end of the roll shaft of the second roll 12*b*, and drives the second roll 12*b* to rotate.

As indicated by dashed line in FIG. 2B, the roll drive unit 13 is configured to be movable to open outward to both sides from the upper side of the roll pair 12. Looking at FIG. 2B, the first roll driver 13*a* is movable outward to the left from the upper side of the first roll 12*a*, and the second roll driver 13*b* is movable outward to the right from the upper side of the second roll 12*b*. Thus, the roll drive unit 13 is attachable to and detachable from the roll pair 12.

The first roll support 14 and the second roll support 15 are positioned below the roll pair 12. The first roll support 14 is positioned below the first roll 12*a*, and supports the lower end of the roll shaft of the first roll 12*a*. The second roll support 15 is positioned below the second roll 12*b*, and supports the lower end of the roll shaft of the second roll 12*b*. As described below, the first roll support 14 also supports the lower side of the second roll support 15. In other words, the first roll support 14 supports not only the lower end of the roll shaft of the first roll 12*a* but also the lower part of the second roll support 15.

The first roll support 14 supports the first roll driver 13*a*, such that the first roll driver 13*a* is movable to open. Similarly, the second roll support 15 supports the second roll driver 13*b*, such that the second roll driver 13*b* is movable to open. Thus, the first roll support 14 directly supports the first roll 12*a* and the first roll driver 13*a*, and indirectly supports the second roll 12*b* and the second roll driver 13*b* via the second roll support 15.

Outward of the first roll support 14 (when seen from the first roll 12*a*, at the opposite side to the second roll 12*b*, which faces the first roll 12*a*), a second slide part 22 included in the slide mechanism 20 is positioned. Also, outward of the second roll support 15 (when seen from the second roll 12*b*, at the opposite side to the first roll 12*a*, which faces the second roll 12*b*), a third slide part 23 included in the slide mechanism 20 is positioned. It should be noted that, in FIG. 2B, for the sake of convenience of the description, the second slide part 22 is surrounded by a dashed line frame, and the third slide part 23 is surrounded by a dotted line frame.

The second slide part 22 slides the first roll support 14. The third slide part 23 slides the second roll support 15. As previously described, the first roll support 14 directly or indirectly supports the roll pair 12, the roll drive unit 13, and the second roll support 15. Accordingly, this means that the second slide part 22 slides the roll pair 12, the roll drive unit 13, and the second roll support 15 together with the first roll support 14. The second roll support 15 supports the second roll 12*b* and the second roll driver 13*b*. Accordingly, this means that the third slide part 23 slides the second roll 12*b* and the second roll driver 13*b* together with the second roll support 15.

The roll pair support 16 is positioned below the second roll support 15. Therefore, the upper part of the roll pair support 16 supports the lower part of the first roll support 14. As previously described, the first roll support 14 also supports the lower part of the second roll support 15. Accordingly, this means that the roll pair support 16 supports the roll pair 12 via the first roll support 14 and the second roll support 15. The roll pair support 16 also supports the second slide part 22 positioned outward of the first roll support 14. It should be noted that, together with the second roll support 15, the third slide part 23 positioned outward of the second roll support 15 is supported by the first roll support 14.

The tilt mechanism 30 is provided below the roll pair support 16. It should be noted that, in FIG. 2B, for the sake of convenience of the description, the tilt mechanism 30 is surrounded by a solid line frame. The tilt mechanism 30 is provided on the upper surface of the stand base 17, and includes a tilt axis part 31, which is provided upright, extending vertically upward. A fitting portion 16*a* is provided on the lower surface of the roll pair support 16, and the tilt axis part 31 is fitted to the fitting portion 16*a*. Accordingly, the roll pair support 16 is rotatable about the tilt axis part 31.

As previously described, the roll pair support 16 supports the first roll support 14 and the second slide part 22; the first roll support 14 supports the first roll 12*a*, the first roll driver 13*a*, the second roll support 15, and the third slide part 23; and the second roll support 15 supports the second roll 12*b* and the second roll driver 13*b*. Accordingly, this means that the roll pair support 16 directly or indirectly supports the first roll support 14, the second roll support 15, the roll pair 12, the roll drive unit 13, the second slide part 22, and the third slide part 23. Since the tilt mechanism 30 supports the roll pair support 16 in a rotatable manner, this means that the tilt mechanism 30 also supports the first roll support 14, the second roll support 15, the roll pair 12, the roll drive unit 13, the second slide part 22, and the third slide part 23 in a rotatable manner.

The tilt mechanism 30 is mounted on the stand base 17. On the stand base 17, a first slide part 21 included in the slide mechanism 20 is also mounted. The first slide part 21 slides the tilt mechanism 30. As previously described, the tilt mechanism 30 supports the roll pair support 16, the first roll support 14, the second roll support 15, the roll pair 12, the roll drive unit 13, the second slide part 22, and the third slide part 23 in a rotatable manner. Accordingly, this means that the first slide part 21 slides the roll pair support 16, the first roll support 14, the second roll support 15, the roll pair 12, the roll drive unit 13, the second slide part 22, and the third slide part 23 together with the tilt mechanism 30.

It should be noted that specific configurations of the roll pair 12, the roll drive unit 13, the supports 14 to 16, the stand base 17, the slide mechanism 20, and the tilt mechanism 30 included in the forming roll part 11 are not particularly limited. Any known configurations are suitably applicable.

Position Adjustment by Forming Roll Part

Next, the adjustment of the position of the roll pair 12 by the slide mechanism 20 and the tilt mechanism 30 of the roll bending apparatus 10 according to the present disclosure is specifically described with reference to FIGS. 3A, 3B, 4A to 4C, and FIG. 5.

Figure 3A:
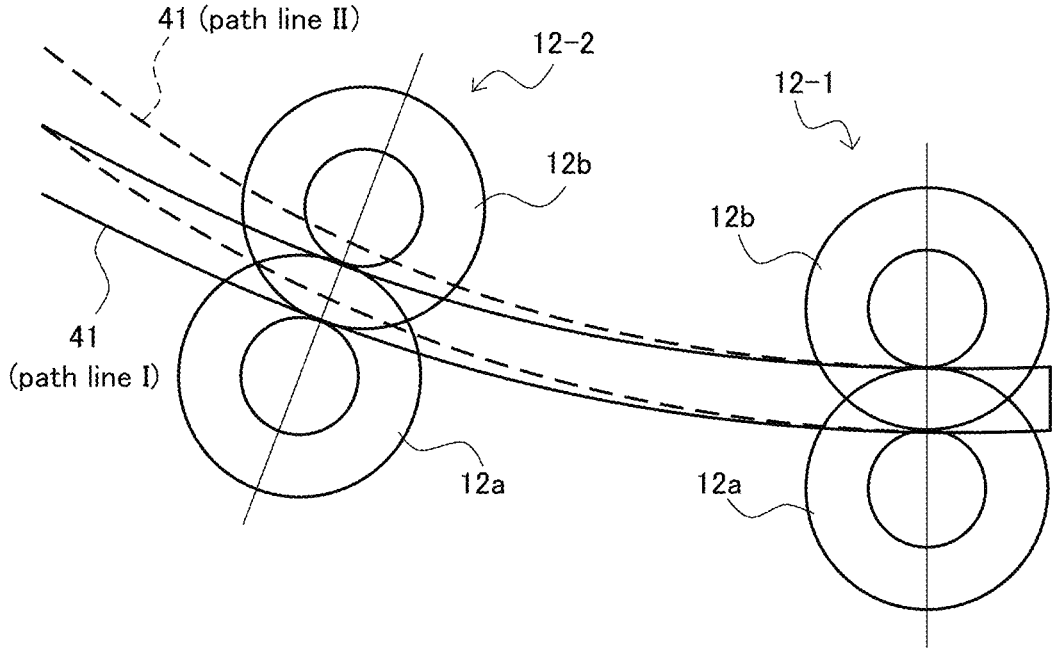
FIG. 3A is a schematic diagram showing one example of a positional relationship between roll pairs of such forming roll parts as shown in FIG. 2A when forming a varying contour in the elongated component in the roll bending apparatus of FIG. 2B.
Figure 3B:
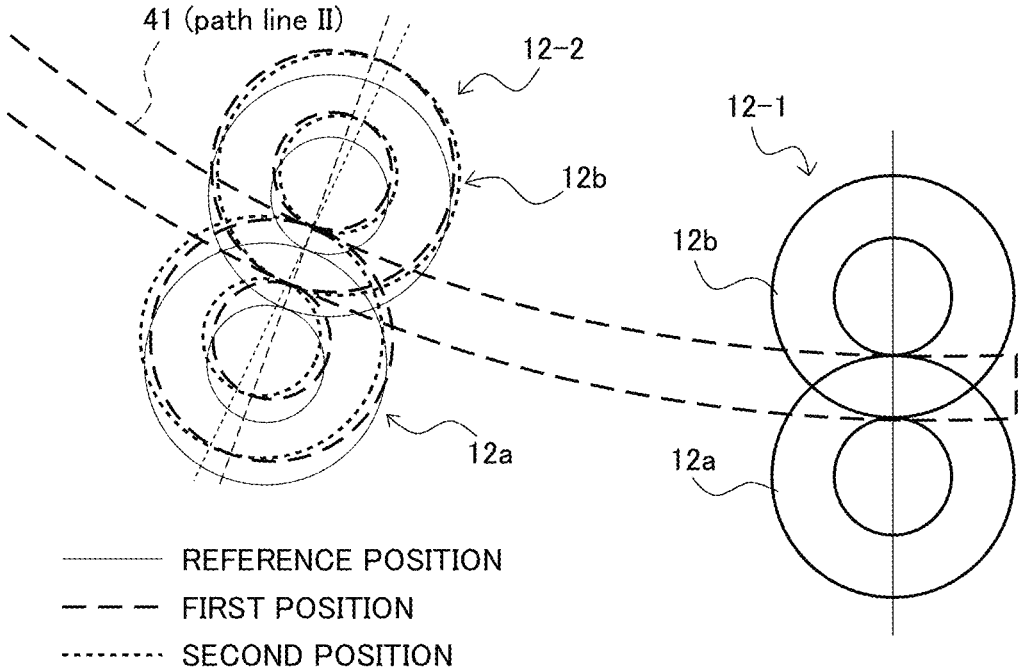
FIG. 3B is a schematic diagram showing one example of positional change that a roll pair in the state of FIG. 3A may make.
Figure 4A:
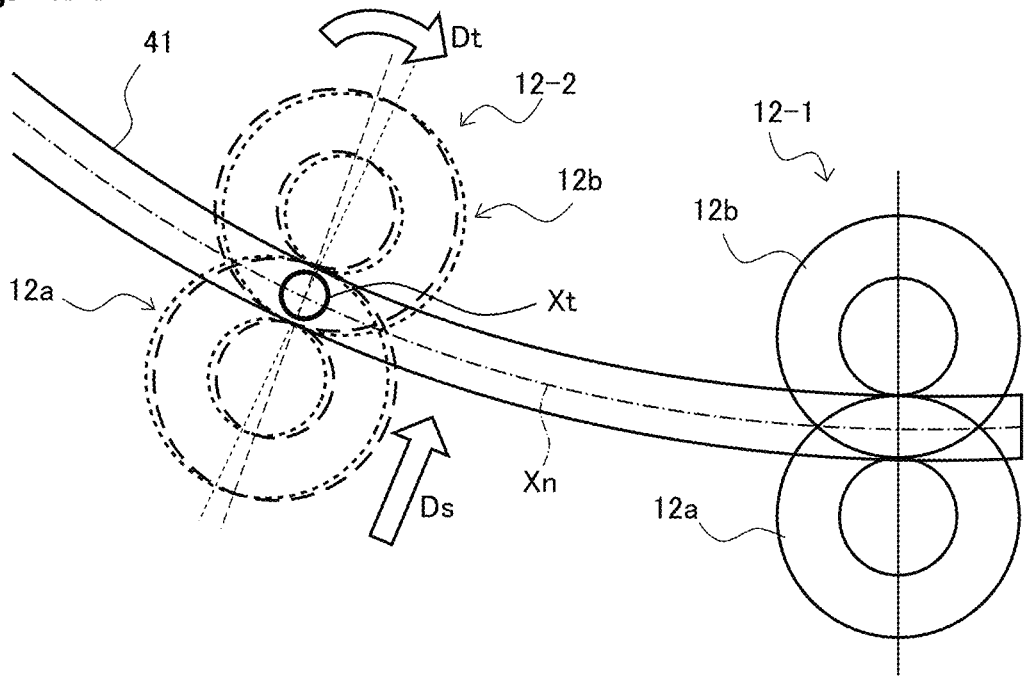
FIG. 4A is a schematic diagram showing one example of positional change of a tilt axis when the roll pair is in the position shown in FIG. 3B, and FIGS. 4B and 4C are schematic diagrams each showing another example of positional change of the tilt axis from the state of FIG. 4A.
Figure 4B:
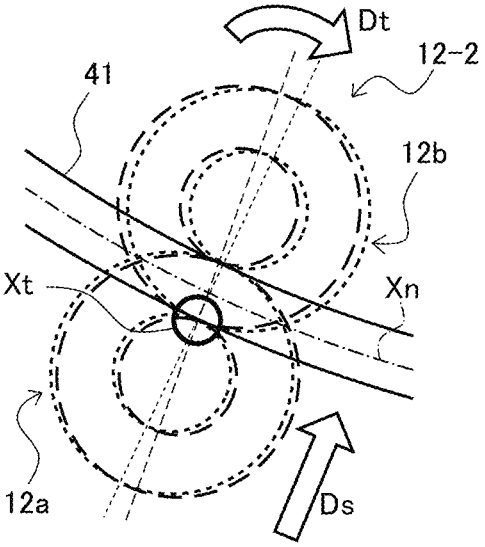
Figure 4C:
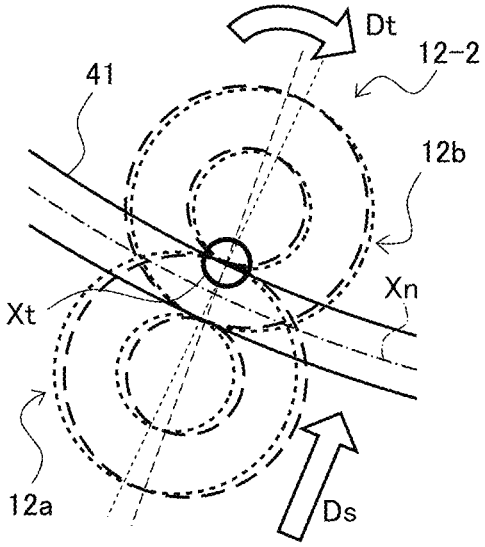

FIG. 3A and FIG. 3B are schematic diagrams each focusing only on, in the roll bending apparatus 10 shown in FIG. 2A, the positional relationship between the roll pairs 12 of the two adjacent forming roll parts 11. In FIG. 3A, a roll pair 12-1 corresponds to the roll pair 12 included in the forming roll part 11 positioned on the upstream side, and a roll pair 12-2 corresponds to the roll pair 12 included in the other forming roll part 11. In FIGS. 3A and 3B, it is assumed that the position of the roll pair 12-1 is not adjusted, but the position of the roll pair 12-2 is adjusted. It should be noted that FIGS. 4A to 4C are schematic diagrams similar to FIGS. 3A and 3B.

As shown in FIG. 3A, a curve is formed in an elongated material 41 by the roll pair 12-1 and the roll pair 12-2 with a path line I represented by solid line in FIG. 3A. In this case, a suitable position of the position-adjustable roll pair 12-2 is, as shown in FIG. 3A, a position in which the elongated material 41 is suitably sandwiched between the first roll 12*a* and the second roll 12*b*. This position is hereinafter referred to as "reference position" for the sake of convenience of the description. In FIG. 3B, the roll pair 12-2 in the "reference position" is illustrated by thin solid line.

Next, as indicated by a path line II, which is represented by dashed line in FIG. 3A, a curve is to be formed in the elongated material 41, such that the curvature is greater than in the case of the path line I, which is represented by solid line. In this case, the position-adjustable roll pair 12-2 is slid so as to be orthogonal to the path line II of the elongated material 41. However, consequently, the position of the roll pair 12-2 becomes a "first position" represented by dashed line in FIG. 3B, which deviates from a suitable position. For the elongated material 41 having the path line II, which is represented by dashed line, the suitable position of the roll pair 12-2 is a "second position", which is represented by dotted line in FIG. 3B.

Assume, for example, that a curve with the curvature of the path line II, which is represented by dashed line, is to be formed also on the second elongated material 41 made of a different raw material from that of the first elongated material 41 in a manner similar to the curve forming of the first elongated material 41. Here, the spring-back amount may be different between the first elongated material 41 and the second elongated material 41 depending on, for example, the Young's modulus, proof stress, or second moment of area of the second elongated material 41. Accordingly, in the case of forming a curve in both the first elongated material 41 and the second elongated material 41 with the path line II represented by dashed line, even though the suitable position of the roll pair 12-2 for the first elongated material 41 is the "second position" represented by dotted line, the suitable position of the roll pair 12-2 for the second elongated material 41 may be a different position, such as the "first position".

That is, even when it is intended to obtain the same curvature for each elongated material 41, it may become necessary to slide the roll pair 12-2 to the "first position", "second position", or another position depending on, for example, the type of the raw material forming the elongated material 41.

In view of the above, in the roll bending apparatus 10 according to the present disclosure, a mechanism configured to tilt the roll pair 12 is combined with, and provided on, a mechanism configured to slide the roll pair 12, such as the above-described slide mechanism 20 and tilt mechanism 30. The tilting center of the roll pair 12 is often set to a position near the neutral axis of the curved elongated material 41, or a position on the inner wall side of the elongated material 41 in the width direction, or a position on the outer wall side of the elongated material 41 in the width direction although the setting of the tilting center of the roll pair 12 depends on various conditions. Accordingly, the roll bending apparatus 10 according to the present disclosure is configured such that the tilting center, i.e., the tilt axis, is variable.

For example, FIG. 4A shows the case of forming a curve in the elongated material 41 with the path line II represented by dashed line, and the neutral axis Xn of the curved elongated material 41 is represented by one-dot chain line. In FIG. 4A, a block arrow Ds indicates the direction of the sliding movement; a block arrow Dt indicates the tilt direction; and a bold circle represents the tilt axis Xt. In the positional relationship shown in FIG. 4A, similar to FIG. 3B, the position of the position-adjustable roll pair 12-2 can be adjusted to the "first position" represented by dashed line or the "second position" represented by dotted line, and also, the position of the tilt axis Xt can be adjusted to a position near the neutral axis Xn.

Alternatively, in the positional relationship shown in FIG. 4B, similar to FIG. 4A and FIG. 3B, the position of the roll pair 12-2 can be adjusted to the "first position" or "second position", and also, the position of the tilt axis Xt can be adjusted to be on the outer wall side (the outer side of the curve, i.e., the protruding side). Similarly, also in the positional relationship shown in FIG. 4C, the position of the roll pair 12-2 can be adjusted to the "first position" or "second position", and also, the position of the tilt axis Xt can be adjusted to be on the inner wall side (the inner side of the curve, i.e., the recessed side). Each of FIG. 4B and FIG. 4C shows the positional adjustment of only the roll pair 12-2. Since FIG. 4A shows the roll pair 12-1, the illustration of the roll pair 12-1 is omitted in FIG. 4B and FIG. 4C.

In other words, the positional adjustments as shown in FIGS. 4A to 4C can be realized by including a mechanism configured to slide the tilt axis Xt and moving the rotational axes (roll axes) of the rolls 12*a* and 12*b* of the roll pair 12 relative to the tilt axis Xt. In the present embodiment, as shown in FIG. 2B, the slide mechanism 20 includes: the first slide part 21 configured to slide the entire forming roll part 11 including the tilt mechanism 30; the second slide part 22 configured to slide the roll pair 12 relative to the tilt axis Xt;

and the third slide part 23 configured to slide at least one of the pair of rolls 12*a* and 12*b* to change the distance between the roll pair 12.

Among these slide parts 21 to 23, the means for sliding the tilt axis Xt is the first slide part 21, and the means for sliding the roll axes relative to the tilt axis Xt is the second slide part 22. The third slide part 23 is the means for sliding the pair of rolls 12*a* and 12*b* to change the distance between their roll axes, and the third slide part 23 can be utilized also for the removal of at least one of the pair of rolls 12*a* and 12*b*.

As one example, assume that the distance between the roll axes of the pair of rolls 12*a* and 12*b* is 200 mm, and the position of the tilt axis Xt is away from one of the roll axes of the rolls 12*a* and 12*b* by 70 mm. Here, it is further assumed that the position of the tilt axis Xt is to be moved such that it is away from the one roll axis by 90 mm. In this case, in the configuration of the forming roll part 11 shown in FIG. 2B, the entire forming roll part 11 is slid by the first slide part 21 by 20 mm, and also, the roll pair 12 is slid by the second slide part 22 by 20 mm in a direction opposite the first slide part 21. Consequently, the tilt axis Xt is shifted (the position of the tilt axis Xt is adjusted) while keeping the same arrangement of the roll pair 12 (i.e., while keeping the path line of the same material). It should be noted that in the case of using a different path line, the first slide part 21 may be further slid, and the roll pair 12 may be rotated by the tilt mechanism 30.

Figure 5:
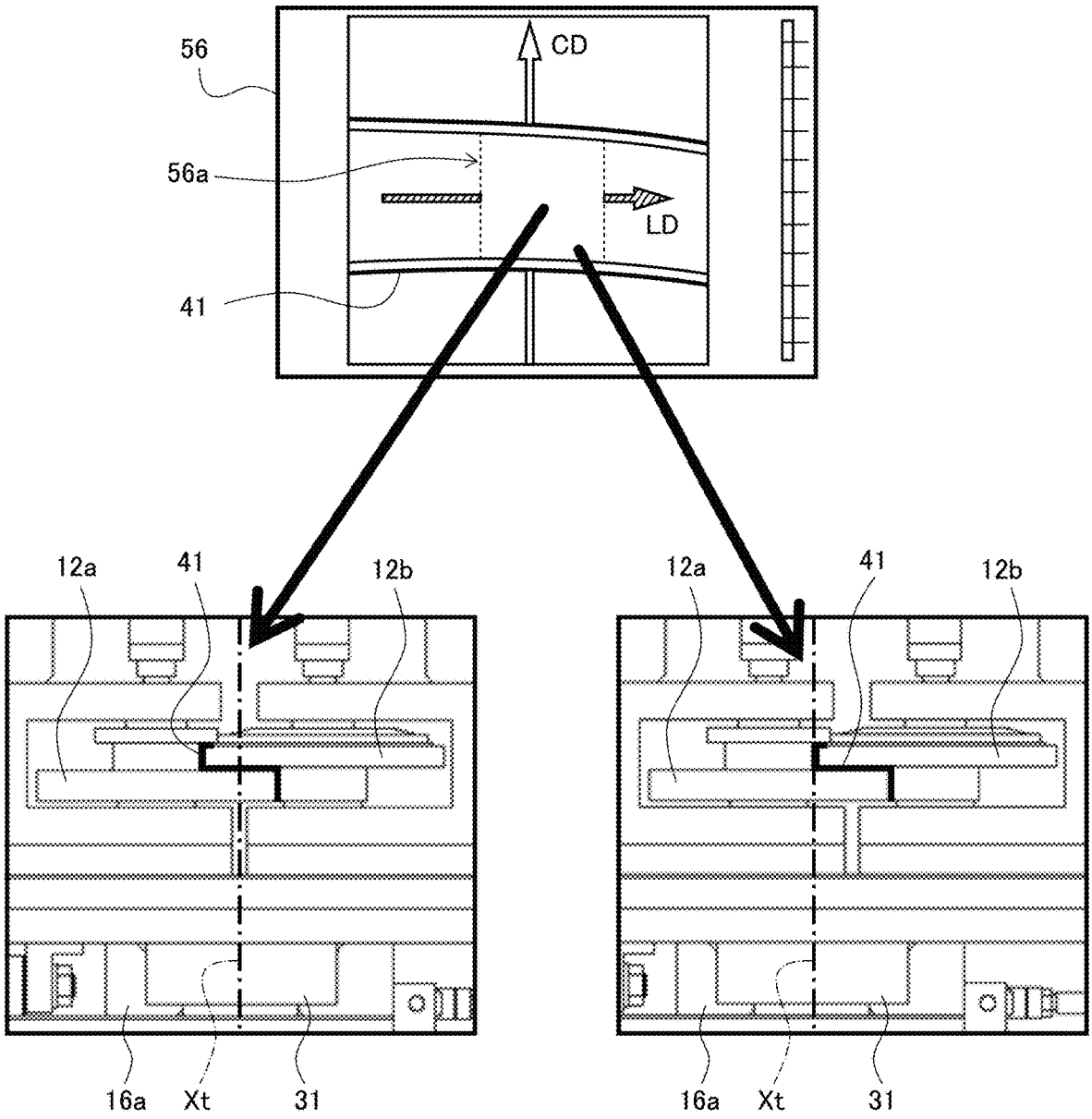
FIG. 5 is a schematic diagram describing one example where the position of the tilt axis shown in FIGS. 4A to 4C is changed based on a strain obtained from image processing.

A specific method used for calculating the neutral axis Xn (see the one-dot chain line in FIGS. 4A to 4C) of the curved elongated material 41 is not particularly limited herein. As one example, as shown in FIG. 5, a method in which an image of the elongated material 41 is captured and the captured image is processed to measure a strain in the elongated material 41 may be adopted. FIG. 5 schematically illustrates an image processing screen 56, which shows an image of the elongated material 41 captured by a known image capturing apparatus. The captured image may be processed by using a known image processing method to measure a strain, and the neutral axis Xn may be calculated by any known method.

In the schematic diagram shown in FIG. 5, an image of a part of the elongated material 41 is captured at the center of the image processing screen 56. An image processing region 56*a*, which is a partial region of the captured image of the elongated material 41, is subjected to image processing, and thereby the neutral axis Xn is calculated. It should be noted that an arrow CD in the image processing screen 56 indicates the width direction of the elongated material 41, and an arrow LD in the image processing screen 56 indicates the longitudinal direction of the elongated material 41. Based on the neutral axis Xn thus calculated, as shown in the lower left part of FIG. 5, the position of the tilt axis Xt can be adjusted to be near the neutral axis Xn (see FIG. 4C), or as shown in the lower right part of FIG. 5, the position of the tilt axis Xt can be adjusted to be on the inner wall side (or the outer wall side) of the elongated material 41, which is in contact with the roll pair 12 (see FIG. 4B).

Operations of Slide Mechanism and Tilt Mechanism

Next, one example of specific operations of the slide mechanism 20 and the tilt mechanism 30 included in the roll bending apparatus 10 (forming roll part 11) according to the present disclosure is specifically described with reference to FIGS. 6 to 12.

Figure 6:
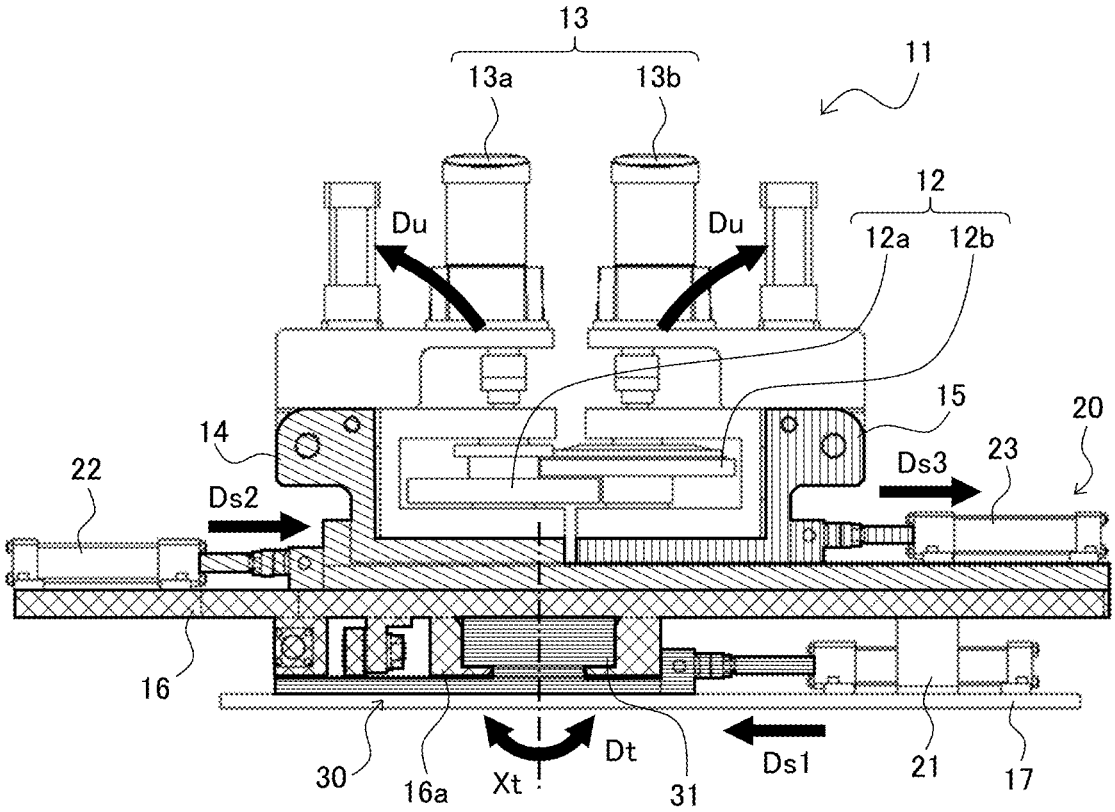
FIG. 6 is a front view illustrating one example of a roll drive unit, a slide mechanism, and a tilt mechanism included in the forming roll part of FIG. 2A.

The roll bending apparatus 10 according to the present disclosure includes the forming roll part 11 configured as shown in FIG. 2B. FIG. 6 specifically shows, in the forming roll part 11, components slid by the slide mechanism 20, directions in which the components are slid, components rotated (tilted) by the tilt mechanism 30, and directions in which the components are rotated. It should be noted that FIG. 6 also specifically shows the detachment directions of the roll drive unit 13.

As shown in FIG. 6, the slide mechanism 20 included in the forming roll part 11 includes at least the first slide part 21, the second slide part 22, and the third slide part 23. As previously described, the first slide part 21 is provided on the stand base 17, and substantially slides almost the entire forming roll part 11 (except the stand base 17) in the direction of a block arrow Ds1. As previously described, the object directly slid by the first slide part 21 is the tilt mechanism 30. In FIG. 6, the tilt mechanism 30 is emphasized as a horizontal hatching region surrounded by a bold frame.

As previously described, the second slide part 22 is provided on the roll pair support 16, and substantially slides the roll pair 12 (and the roll drive unit 13) in the direction of a block arrow Ds2. As previously described, the object directly slid by the second slide part 22 is the first roll support 14. In FIG. 6, the first roll support 14 is emphasized as a diagonal hatching region surrounded by a bold frame.

As previously described, the third slide part 23 is provided on the first roll support 14. In the present embodiment, the third slide part 23 slides the second roll 12*b* of the roll pair 12 (and the second roll driver 13*b*) in the direction of a block arrow Ds3. As previously described, the object directly slid by the third slide part 23 is the second roll support 15. In FIG. 6, the second roll support 15 is emphasized as a vertical hatching region surrounded by a bold frame.

As previously described, the tilt mechanism 30 is provided on the stand base 17, and includes the tilt axis part 31, which is provided upright on the upper surface of the stand base 17. Since the fitting portion 16*a* of the roll pair support 16 is fitted to the tilt axis part 31, the roll pair support 16 and most of the forming roll part 11 supported thereby (except the tilt mechanism 30 and the first slide part 21) are rotated by the tilt mechanism 30 about the tilt axis Xt in the direction of the block arrow Dt. In FIG. 6, the roll pair support 16, which is the object directly rotated by the tilt mechanism 30, is emphasized as a diagonal cross hatching region surrounded by a bold frame.

As previously described, the first roll driver 13*a* and the second roll driver 13*b* of the roll drive unit 13 move in directions indicated by block arrows Du to open outward from the upper side. As a result, the roll drive unit 13 detaches from the roll pair 12. In the configuration shown in FIG. 6 (and FIG. 2B), the roll drive unit 13 makes the detaching movement to open from the upper side. However, the manner in which the roll drive unit 13 makes the detaching movement is not thus limited. For example, the first roll driver 13*a* and the second roll driver 13*b* may slide outward. Alternatively, the roll drive unit 13 may make the detaching movement to open from the lateral side.

It should be noted that, in FIG. 6, the direction (indicated by the block arrow Ds1) of the sliding movement of the first slide part 21 points to the left in the diagram; the direction (indicated by the block arrow Ds2) of the sliding movement of the second slide part 22 points to the right in the diagram; and the direction (indicated by the block arrow Ds3) of the sliding movement of the third slide part 23 points to the right in the diagram. However, these directions of the sliding movement of the slide mechanism 20 are not particularly limited, but may be reverse to the illustrated directions.

The state shown in FIG. 6 (and FIG. 2B) can be seen as a "basic state" where the slide mechanism 20 has not operated. Therefore, the state shown in FIG. 6 can be seen as a state from which the slide parts 21 to 23 move their sliding objects in the directions of the block arrows Ds1 to Ds3, respectively, but do not move them in the reverse directions. For the sake of convenience of the description, if the sliding movement directions shown in FIG. 6 are defined as "forward directions" of the sliding movement of the slide parts 21 to 23, then it can be said that in the state shown in FIG. 6, the slide parts 21 to 23 are in the state of being movable only in the forward directions. In other words, if the slide parts 21 to 23 have operated in the forward directions to some extent, then the slide parts 21 to 23 can slide their sliding objects in the "reverse directions" to the forward directions.

Here, although the sliding movement directions of the slide parts 21 to 23 vary between the forward direction and the reverse direction, each of the forward and reverse directions is set as the first normal direction, which is present on a plane including the conveying direction F (see FIG. 2A) of the elongated material 41, the first normal direction being normal to the conveying direction F. Such setting is intended for sliding the roll pair 12 so as to be orthogonal to the path line of the elongated material 41, which is subjected to the forming.

Among the slide parts 21 to 23, the forward sliding direction of the first slide part 21 configured to substantially slide almost the entire forming roll part 11 and the forward sliding direction of the second slide part 22 configured to substantially slide the roll pair 12 are substantially reverse to each other. This makes it possible to make the configuration of the slide mechanism 20 simple and compact. For example, if the amount of sliding movement of the first slide part 21 and the amount of sliding movement of the second slide part 22 are set to be the same amount, then the position of the tilt axis Xt can be adjusted without changing the distance between the roll axes (i.e., without changing the path line of the elongated material 41).

Meanwhile, the third slide part 23 may be slid so as to change the distance between the roll axes of the pair of rolls 12*a* and 12*b*. Therefore, it is not essential that the direction shown in FIG. 6 (the same direction as the forward direction of the second slide part 22) be set as the forward direction of the third slide part 23. In the configuration shown in FIG. 6, only the second roll 12*b* is configured to slide. However, as an alternative, only the first roll 12*a* may be configured to slide, or both the rolls 12*a* and 12*b* may be configured to slide.

Figure 7:
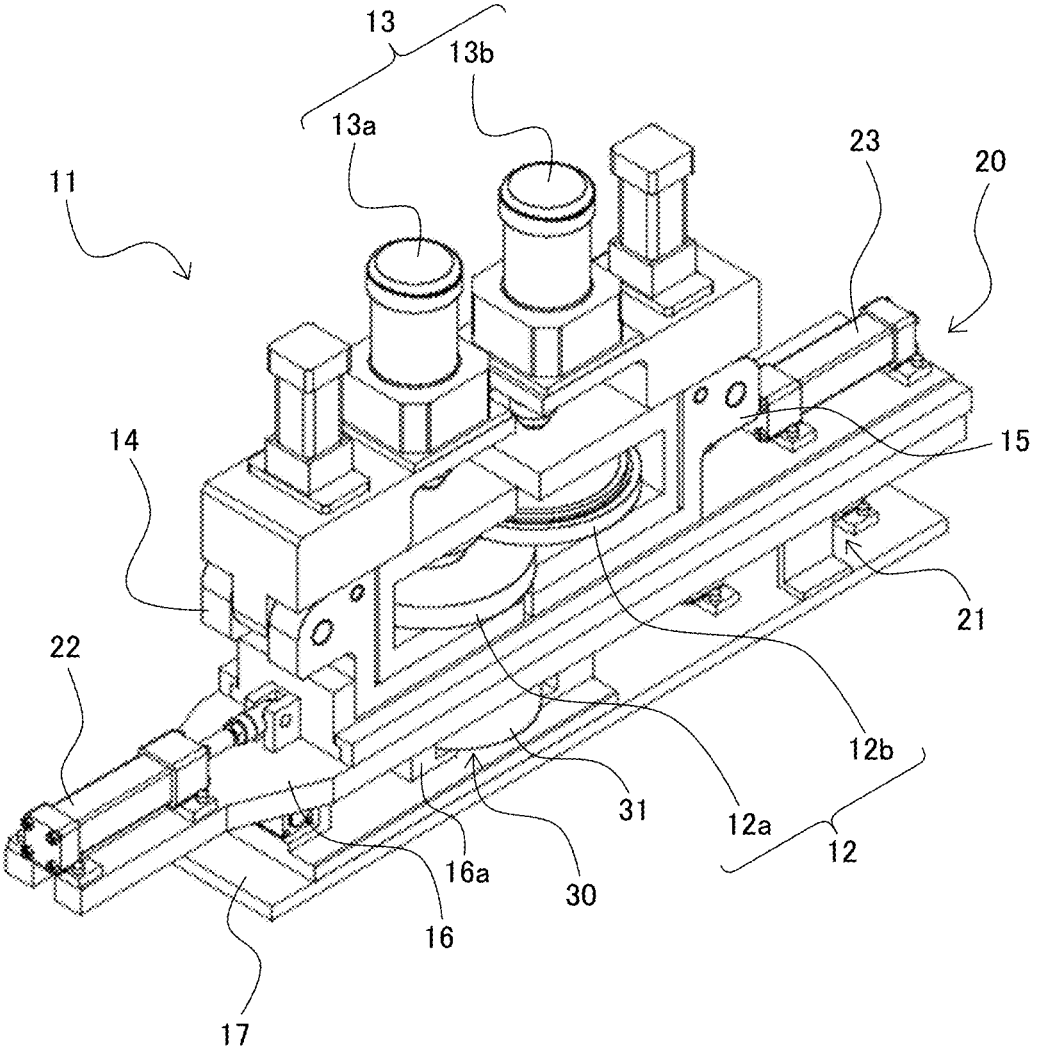
FIG. 7 is a perspective view showing a state where none of the roll drive unit, the slide mechanism, and the tilt mechanism of the forming roll part of FIG. 6 have operated.

Next, states where the roll drive unit 13, the slide mechanism 20, and the tilt mechanism 30 have operated are described with reference to FIGS. 7 to 12. First, the state of the forming roll part 11 shown in a perspective view of FIG. 7 is the basic state shown in FIG. 6, in which none of the roll drive unit 13, the slide mechanism 20, and the tilt mechanism 30 have operated.

Figure 8:
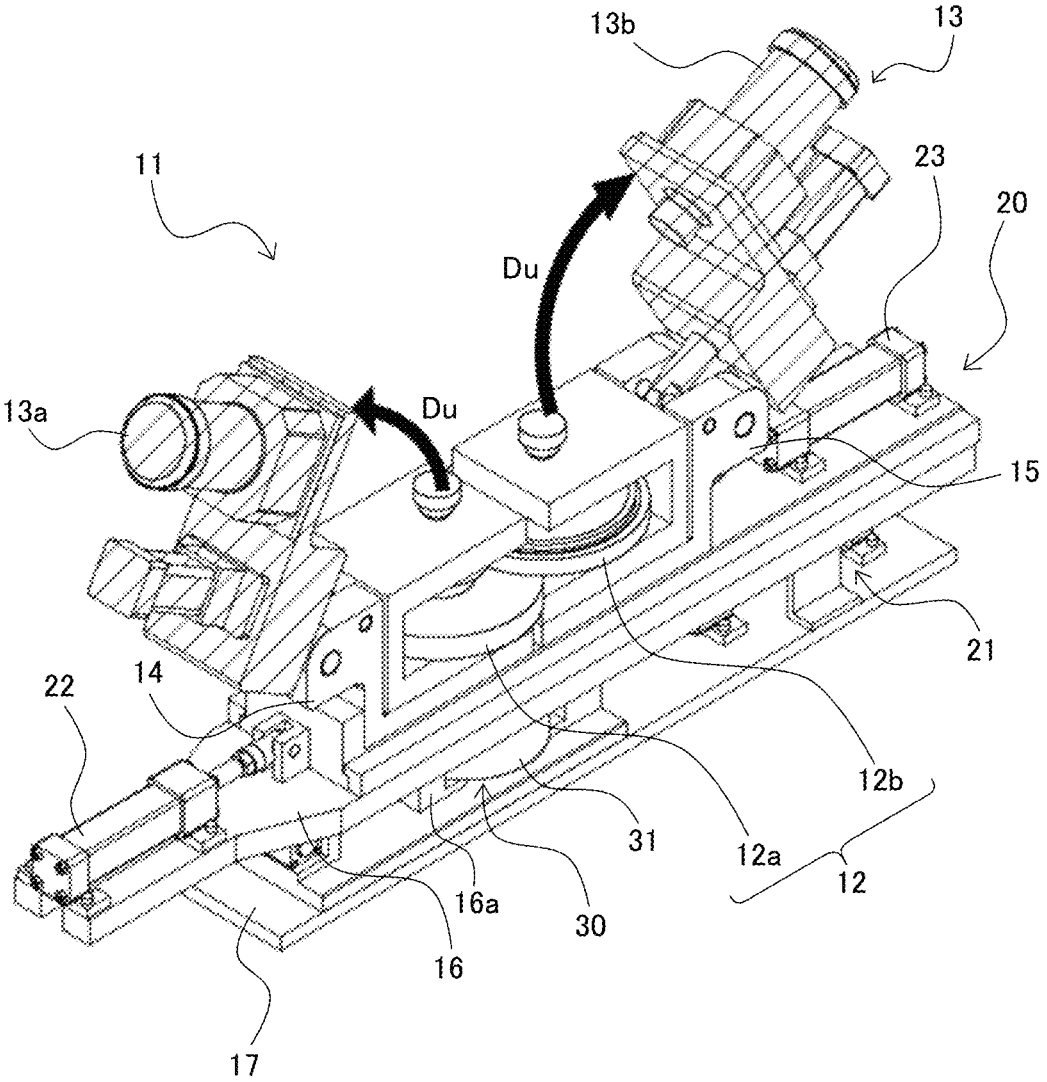
FIG. 8 is a perspective view showing a state where the roll drive unit of the forming roll part of FIG. 7 has detached from the roll pair.

Next, the state of the forming roll part 11 shown in FIG. 8 is a state where the roll drive unit 13 has operated. As shown in FIG. 8, the first roll driver 13*a* and the second roll driver 13*b* have detached from the first roll 12*a* and the second roll 12*b*, respectively, and as indicated by the block arrows Du, the first roll driver 13*a* and the second roll driver 13*b* have moved outward to open. It should be noted that, in FIG. 8, the roll drive unit 13, which is the moved object, is emphasized by diagonal hatching.

Figure 9:
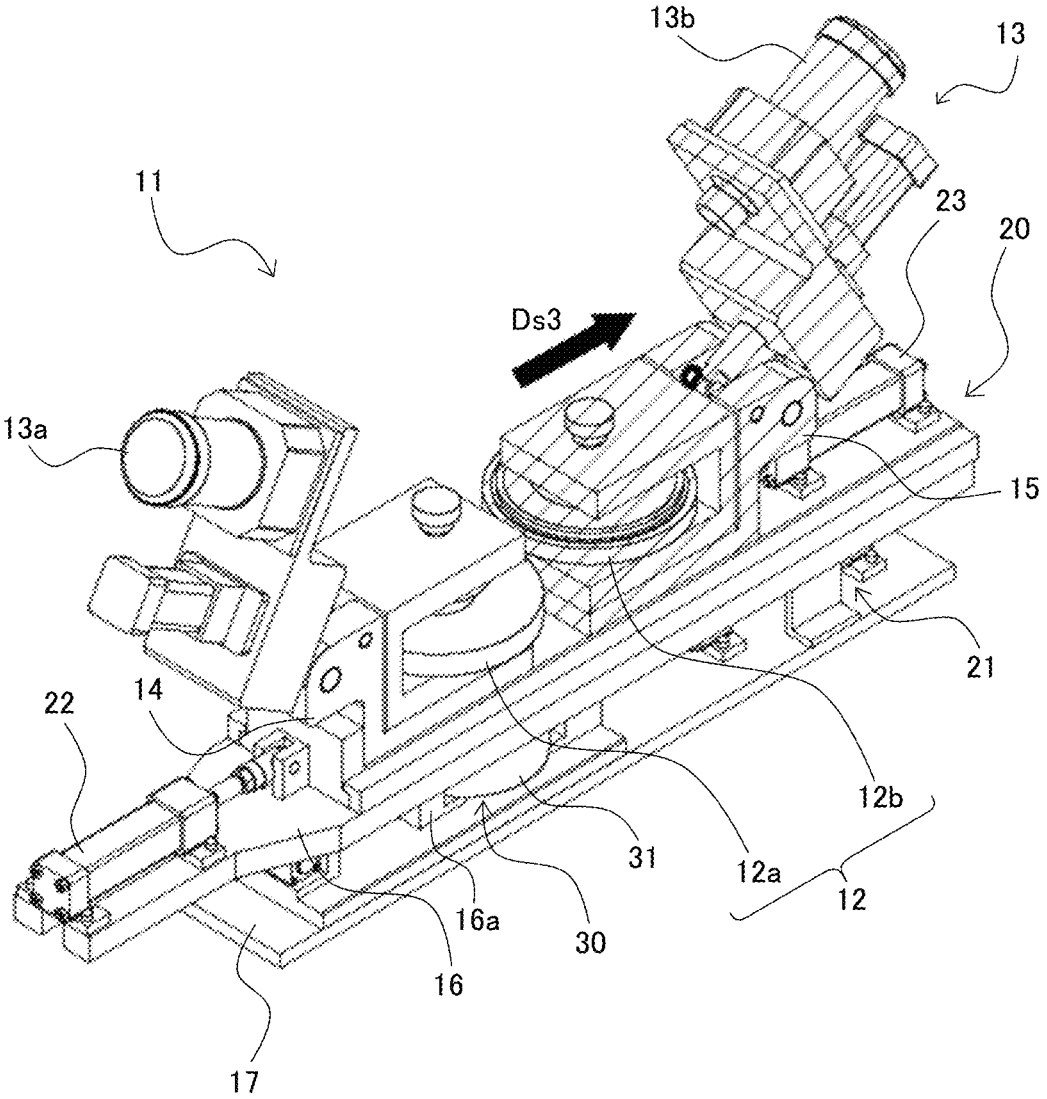
FIG. 9 is a perspective view showing a state where a third slide part of the slide mechanism of the forming roll part of FIG. 8 has operated.

Next, the state of the forming roll part 11 shown in FIG. 9 is a state where the third slide part 23 has operated in addition to the roll drive unit 13. Since the roll drive unit 13 has already operated, the second roll driver 13*b* has moved and is open outward. The third slide part 23 slides the second roll support 15 in this state in the direction of the block arrow Ds3. As a result, the distance between the roll axes of the first roll 12*a* and the second roll 12*b* is expanded. It should be noted that, also in FIG. 9, the second roll support 15 and the second roll driver 13*b*, which are the moved objects, are emphasized by diagonal hatching.

Figure 10:
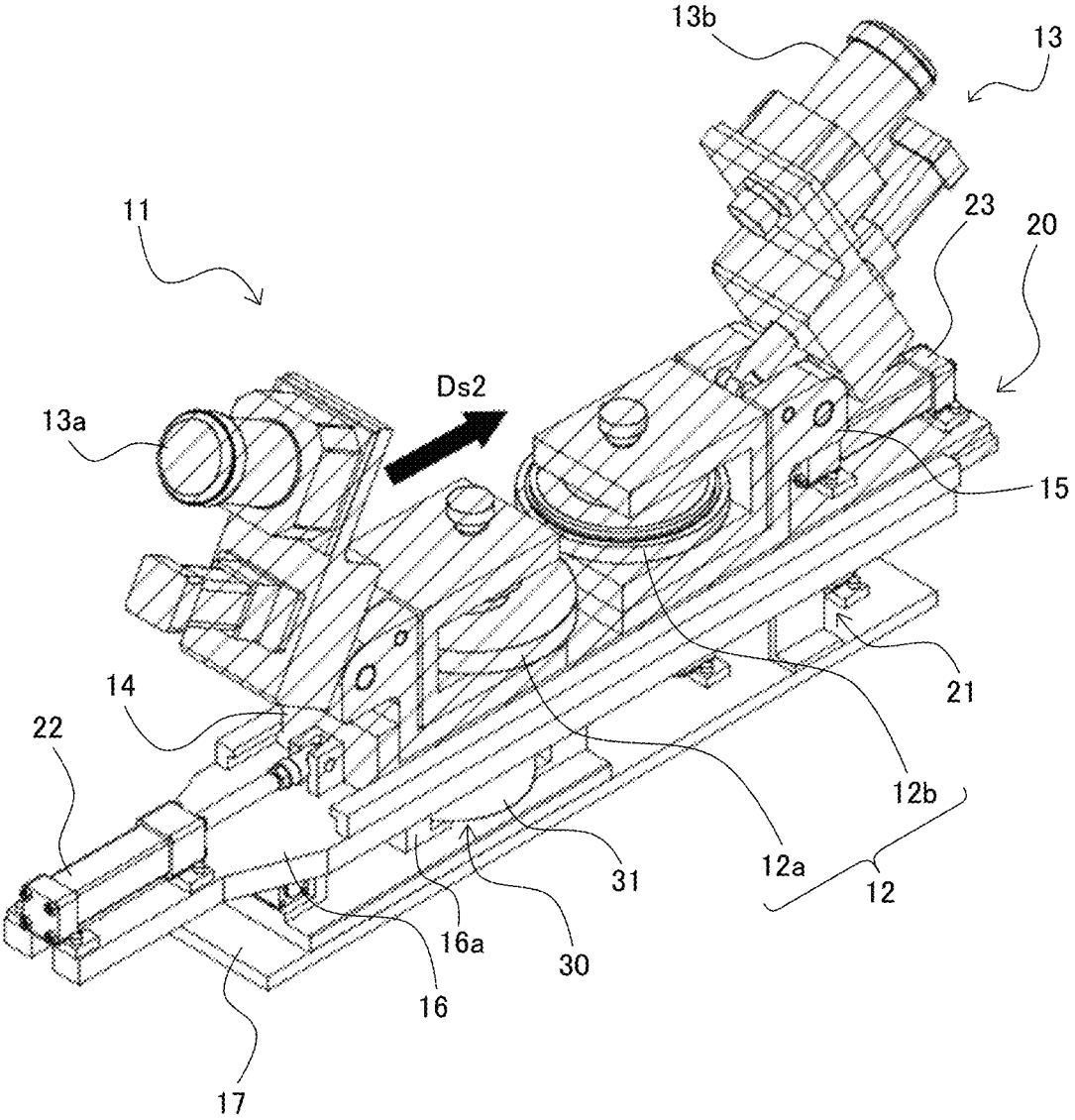
FIG. 10 is a perspective view showing a state where a second slide part of the slide mechanism of the forming roll part of FIG. 9 has operated.

Next, the state of the forming roll part 11 shown in FIG. 10 is a state where the second slide part 22 has operated in addition to the roll drive unit 13 and the third slide part 23. The roll drive unit 13 is already open outward, and the second roll 12*b* has already slid away from the first roll 12*a*. Further, since the second slide part 22 slides the first roll support 14 in the direction of the block arrow Ds2, the roll pair 12, the second roll support 15, and the roll drive unit 13 supported on the first roll support 14 are also slid. It should be noted that, also in FIG. 10, the first roll support 14, the roll pair 12, the second roll support 15, and the roll drive unit 13, which are the moved objects, are emphasized by diagonal hatching.

Figure 11:
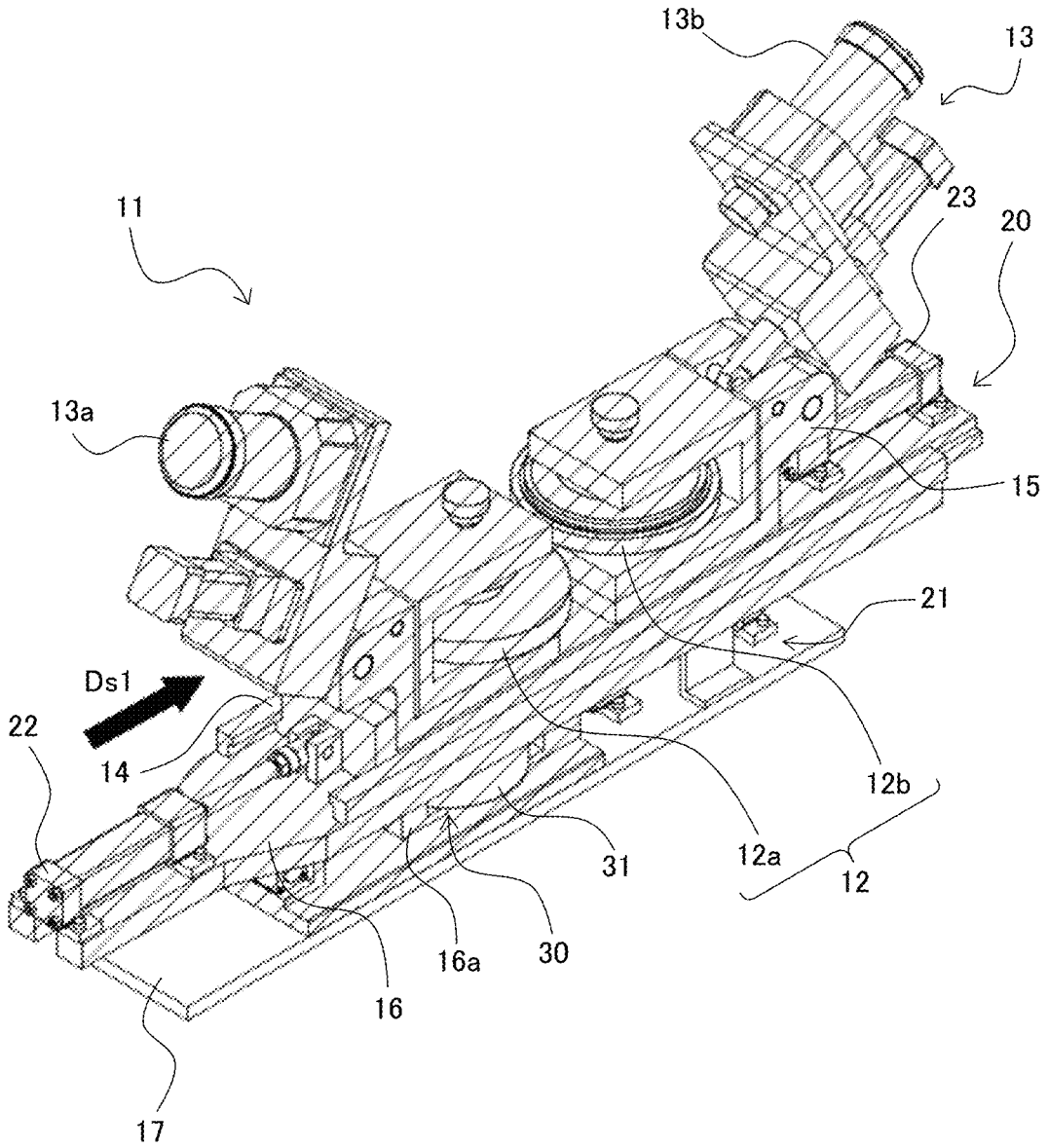
FIG. 11 is a perspective view showing a state where a first slide part of the slide mechanism of the forming roll part of FIG. 10 has operated.

Next, the state of the forming roll part 11 shown in FIG. 11 is a state where the first slide part 21 has operated in addition to the roll drive unit 13, the third slide part 23, and the second slide part 22. The roll drive unit 13 is already open outward; the second roll 12*b* has already slid away from the first roll 12*a*; and the first roll support 14 has already slid from the basic state. Since the first slide part 21 slides the tilt mechanism 30 and the roll pair support 16 supported thereon in the direction of the block arrow Ds1, the entire forming roll part 11 is substantially slid. It should be noted that, also in FIG. 11, the tilt mechanism 30, the roll pair support 16, the first roll support 14, the roll pair 12, the second roll support 15, and the roll drive unit 13, which are the moved objects, are emphasized by diagonal hatching.

Figure 12:
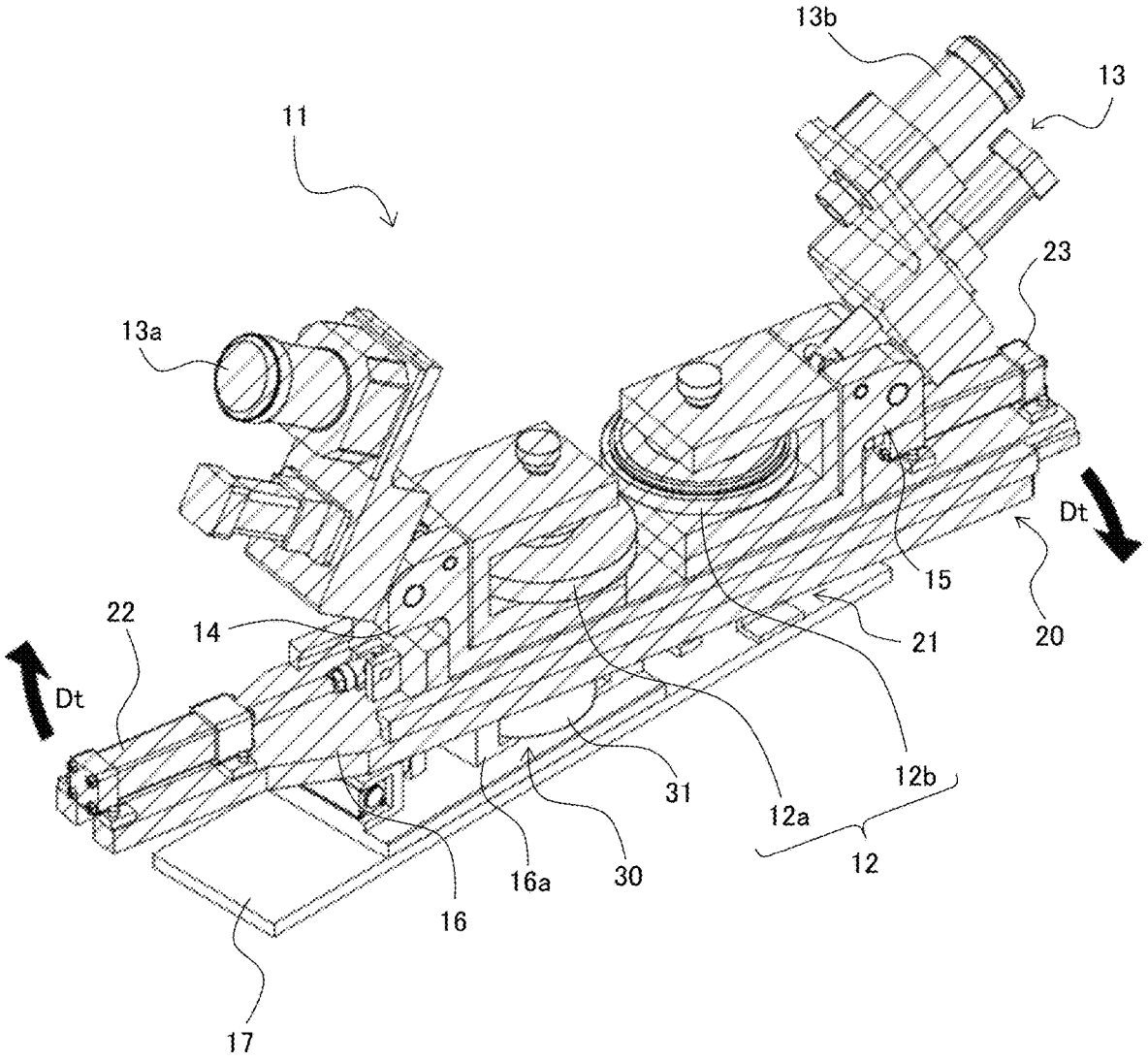
FIG. 12 is a perspective view showing a state where the tilt mechanism of the forming roll part of FIG. 11 has operated.

Next, the state of the forming roll part 11 shown in FIG. 12 is a state where the tilt mechanism 30 has operated in addition to the roll drive unit 13 and the slide parts 21 to 23. The roll drive unit 13 is already open outward; the second roll 12*b* has already slid away from the first roll 12*a*; the first roll support 14 has already slid from the basic state; and almost the entire forming roll part 11 has already slid from the basic state. The tilt mechanism 30 rotates the roll pair support 16, which is fitted to the tilt axis part 31 by the fitting portion 16*a*, about the tilt axis part 31 in the direction of the block arrow Dt. As a result, most of the forming roll part 11 except the tilt mechanism 30 (and except the first slide part 21) rotates. It should be noted that, also in FIG. 12, the roll pair support 16, the first roll support 14, the roll pair 12, the second roll support 15, and the roll drive unit 13, which are the moved objects, are emphasized by diagonal hatching.

As described above, in the present disclosure, the slide mechanism 20 may be configured to slide the roll pair 12 on a plane including the conveying direction of the elongated material, which is subjected to the forming, in the first normal direction normal to the conveying direction, and the tilt mechanism 30 may be configured to rotate the roll pair 12 about the tilt axis Xt extending in the second normal direction normal to the conveying plane, which includes the conveying direction and the first normal direction. By thus moving the slide axis of the slide mechanism 20 and the tilt axis Xt of the tilt mechanism 30, the adjustment can be made so that the elongated material 41 will have a desired path line (i.e., so that the elongated component 40 will have a desired contour).

In the present embodiment, as previously described, as one preferable example of the configuration of the slide mechanism 20, the slide mechanism 20 includes: the first slide part 21 configured to slide at least the tilt mechanism 30 and the roll pair 12 collectively in the first normal direction; and the second slide part 22 configured to slide the roll pair 12 in the first normal direction to change the position of the roll pair 12 relative to the tilt axis Xt. In the present embodiment, as another preferable example of the configuration of the slide mechanism 20, the slide mechanism 20 further includes the third slide part 23 configured to slide at least one of the pair of rolls 12*a* and 12*b* forming the roll pair 12 in the first normal direction to change the gap between the rolls 12*a* and 12*b*.

Configuration Example of Roll Bending Apparatus

Next, a more specific configuration example of the roll bending apparatus 10 according to the present disclosure is specifically described with reference to FIGS. 13 to 18.

As previously described, the roll bending apparatus 10 according to the present disclosure may include the forming roll part 11, which is provided with the slide mechanism 20 and the tilt mechanism 30 as illustratively shown in, for example, FIG. 2B, and the specific configuration thereof is not particularly limited.

In the roll bending apparatus 10 according to the present disclosure, as shown in FIG. 2A, the bending path 50 (represented by one-dot chain line in FIG. 2A) of the elongated material 41 includes a straight path portion and a curved path portion for forming a curve in the elongated material 41. At least one forming roll part 11 is required to be disposed on the curved path portion of the bending path 50. More specifically, as shown in FIG. 2A, on the curved path portion, one forming roll part 11 may be disposed at the most upstream position on the curved path portion in the conveying direction F (see FIG. 2A), and on the straight path portion adjacent to the curved path portion, another forming roll part 11 may be disposed at the most downstream position on the straight path portion in the conveying direction F.

It should be noted that, in the configuration shown in FIG. 2A, two cross-sectional-shape-forming roll bending parts 52 are provided upstream of the forming roll part 11 disposed on the straight path portion. As thus described, the roll bending apparatus 10 includes the plurality of roll bending parts 51, which are arranged in the conveying direction F of the elongated material 41. At least one of the plurality of roll bending parts 51 is required to be the forming roll part 11 (i.e., the roll bending part 51 including the slide mechanism 20 and the tilt mechanism 30).

Figure 13:
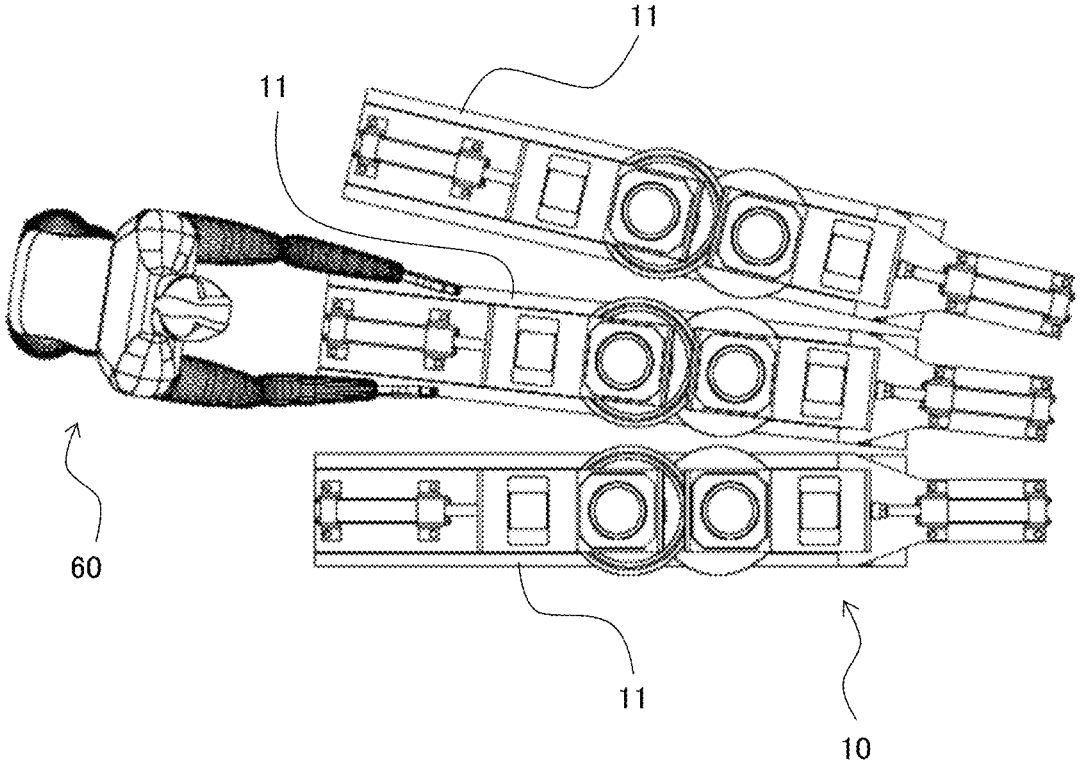
FIG. 13 is a schematic top view showing a more specific example of the roll bending apparatus of FIG. 2B.
Figure 14:
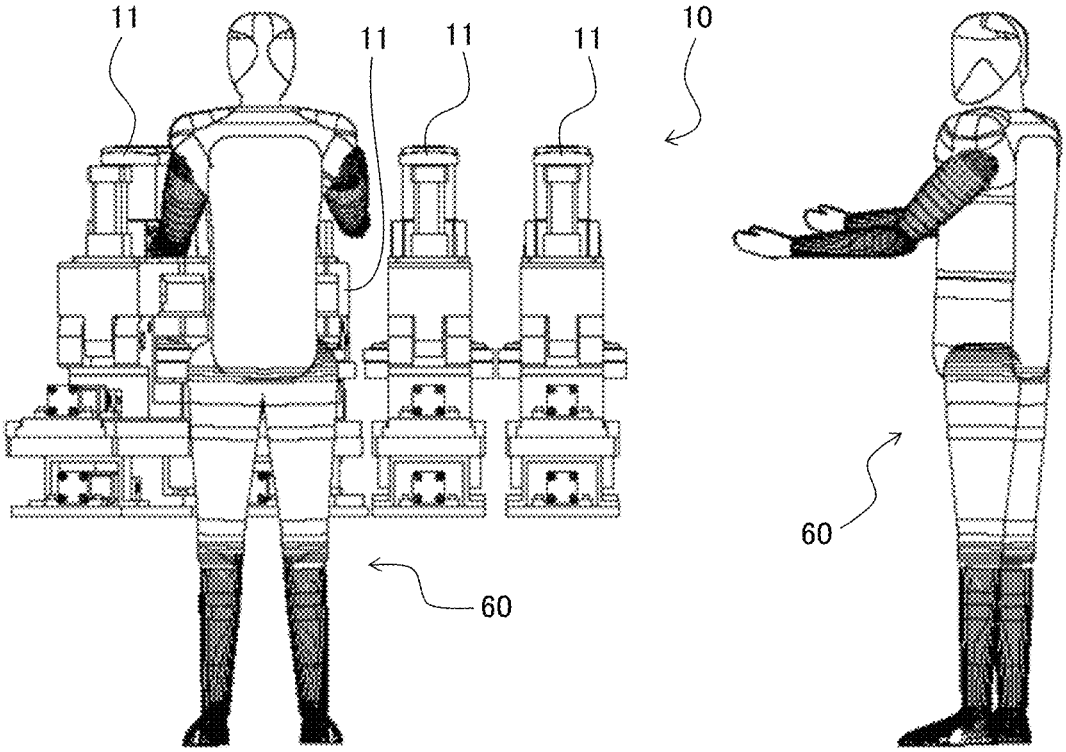
FIG. 14 is a schematic side view showing a more specific example of the roll bending apparatus of FIG. 2B.
Figure 15:
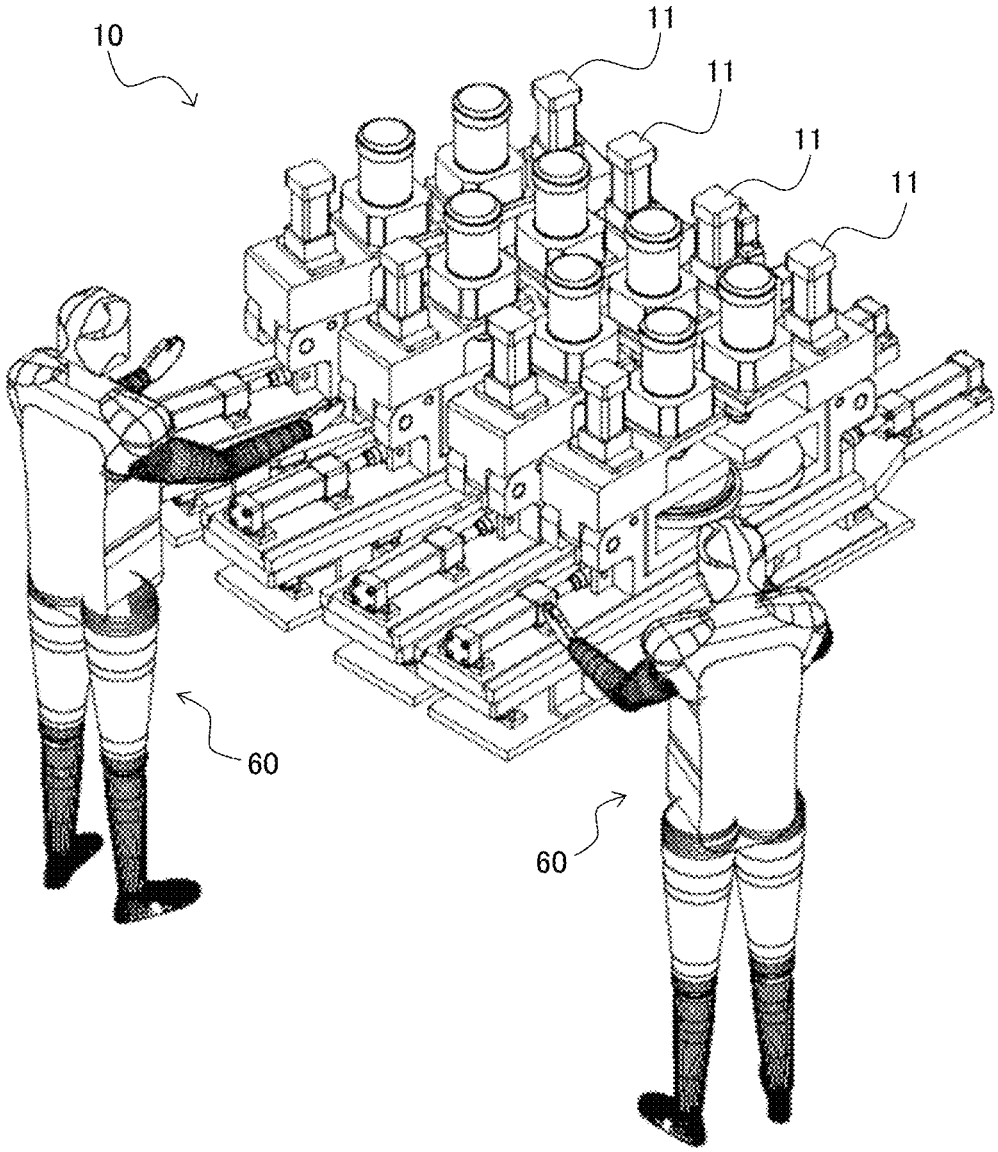
FIG. 15 is a schematic perspective view showing a more specific example of the roll bending apparatus of FIG. 2B.

Alternatively, all the roll bending parts 51 included in the roll bending apparatus 10 may be the forming roll parts 11 each including the slide mechanism 20 and the tilt mechanism 30. Specifically, for example, as shown in FIG. 13, the roll bending apparatus 10 may be configured to include three forming roll parts 11, or as shown in FIG. 14 or FIG. 15, the roll bending apparatus 10 may be configured to include four forming roll parts 11.

For the sake of convenience of the description, the forming roll part 11 disposed on the straight path portion of the bending path 50 may be referred to as a "straight-position-type" forming roll part 11, and the forming roll part 11 disposed on the curved path portion may be referred to as an "inclined-position-type" forming roll part 11. In this case, the roll bending apparatus 10 shown in FIG. 13 is configured to include one forming roll part 11 of the straight-position-type and two forming roll parts 11 of the inclined-position-type, whereas the roll bending apparatus 10 shown in FIG. 14 or FIG. 15 is configured to include two forming roll parts 11 of the straight-position-type and two forming roll parts 11 of the inclined-position-type.

It should be noted that, in FIGS. 13 to 18, among the components of the roll bending apparatus 10, only the forming roll parts 11 are shown for the sake of convenience of the description. FIGS. 13 to 18 also show operators 60, and schematically illustrate the positions of the operators 60 when the operators 60 manually operate the roll bending apparatus 10 or the forming roll parts 11.

The roll drive unit 13 of the forming roll part 11 configured as shown in FIG. 2B is movable to detach from the roll pair 12 as indicated by the block arrows Du in FIG. 6 or FIG. 8. Here, after the roll drive unit 13 has detached from the roll pair 12, the distance between the roll axes of the pair of rolls 12*a* and 12*b* may be expanded by the third slide part 23 of the slide mechanism 20. This consequently allows the operators 60 to readily perform, for example, replacement or maintenance of the rolls 12*a* and 12*b* in the forming roll part 11 as shown in FIGS. 16 to 18.

For example, as a result of the roll drive unit 13 moving to detach from the roll pair 12, the roll pair 12 is removed from the roll drive unit 13. Therefore, replacement of the roll pair 12 or one of the pair of rolls 12*a* and 12*b*, or changing them into different types of rolls, can be readily performed. Moreover, the distance between the roll axes of the pair of rolls 12*a* and 12*b* can be expanded by the third slide part 23, and thereby, for example, replacement of the rolls 12*a* and 12*b*, or changing them into different types of rolls, can be more readily performed. Furthermore, since the distance between the roll axes of the rolls 12*a* and 12*b* is adjustable, elongated materials 41 having different thicknesses from each other can be readily fed into between the roll pair 12.

Figure 16:
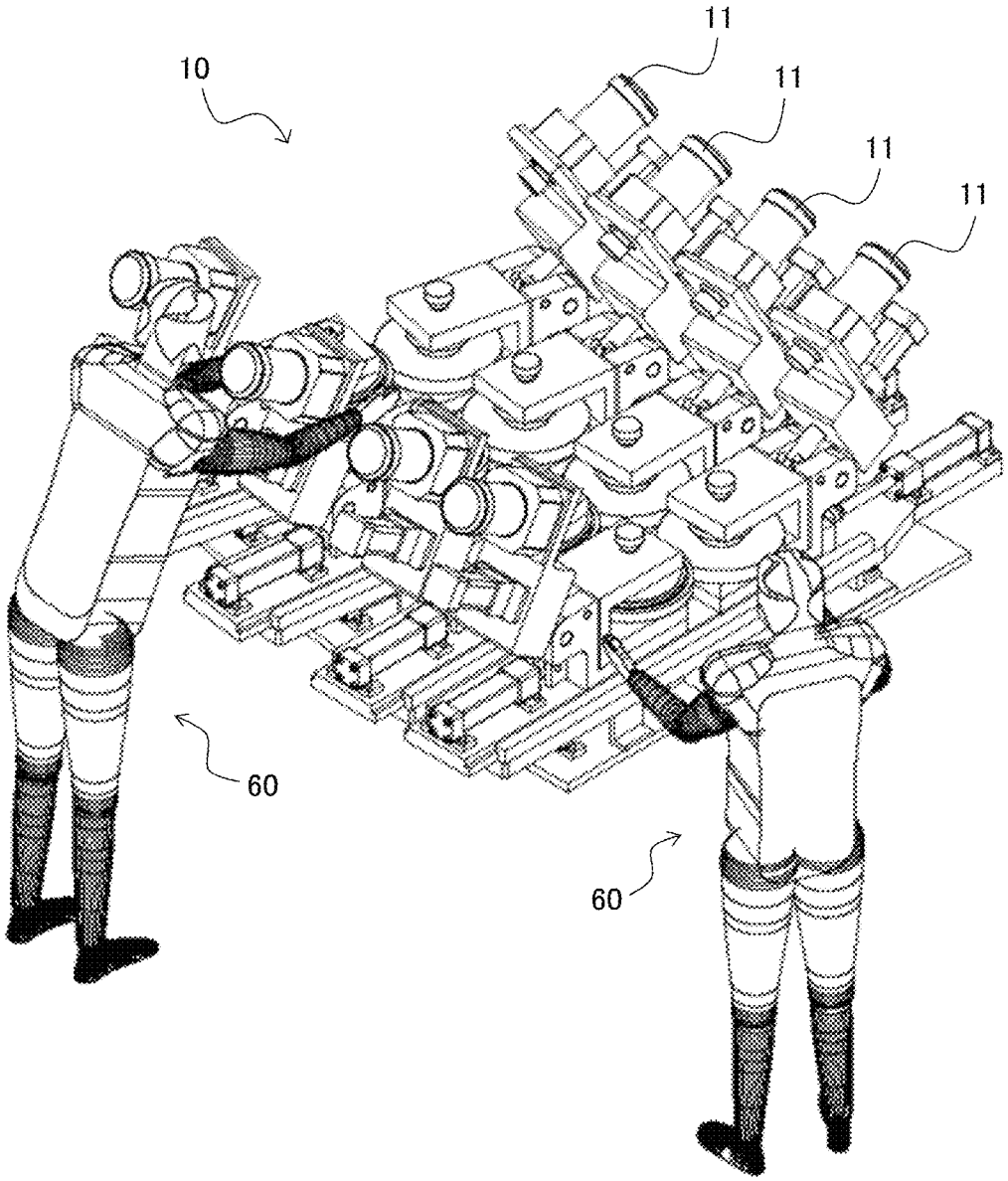
FIG. 16 is a schematic perspective view showing a state where the roll drive units have detached from the roll pairs in the roll bending apparatus of FIG. 15.
Figure 17:
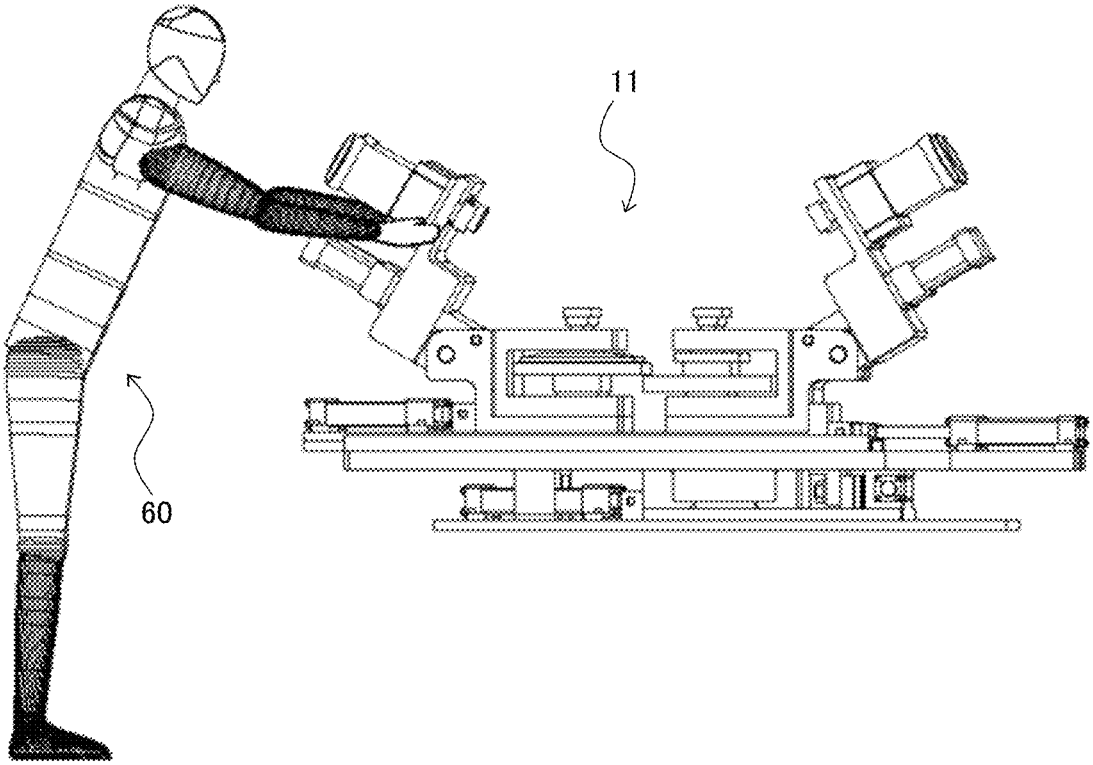
FIG. 17 is a schematic front view showing a state where the roll drive unit has detached from the roll pair in the roll bending apparatus of FIG. 13.
Figure 18:
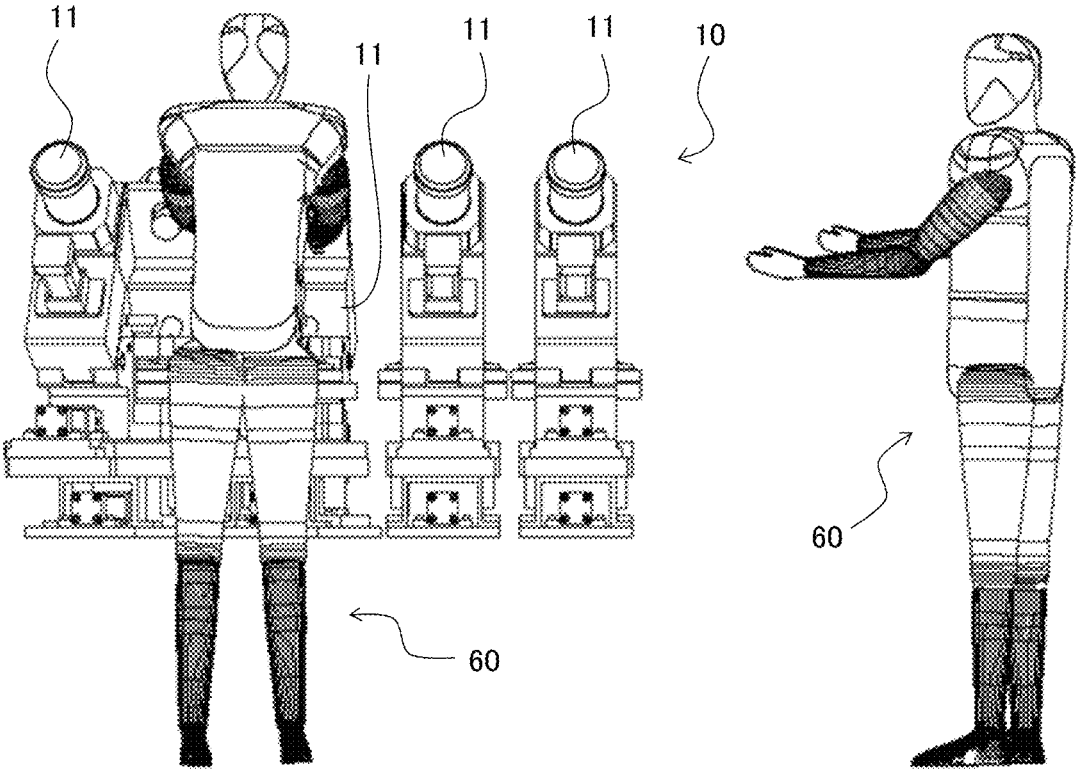
FIG. 18 is a schematic side view showing a state where the roll drive units have detached from the roll pairs in the roll bending apparatus of FIG. 14.

As shown in FIG. 17 (or FIG. 16 or FIG. 18), the operator 60 can handle the roll pair 12 from the outside of the forming roll part 11 (from a direction crossing the conveying direction F), and as shown in FIG. 16 or FIG. 18, the operator 60 can handle the roll pair 12 from the front side of the forming roll part 11 (from a direction coinciding with the conveying direction F).

It should be noted that, in the roll bending apparatus 10 shown in FIGS. 13 to 18, all the forming roll parts 11 included therein are configured to form a curve in the elongated material 41. However, the roll bending apparatus 10 according to the present disclosure is not thus limited. The roll bending apparatus 10 may include the roll bending part(s) 52 for forming a predefined cross-sectional shape as shown in the example of FIG. 2A.

Specifically, another roll bending apparatus 10 according to the present embodiment may include a plurality of roll bending parts 51, and the plurality of roll bending parts 51 may be configured to include: a cross-sectional-shape-forming roll bending part 51 configured to roll-form an elongated plate member that is the elongated material 41 into an elongated component having a predefined cross-sectional shape; and a curve-forming forming roll part 11 configured to further form a curve in the elongated component that is the elongated material 41 and that has been formed to have the cross-sectional shape. In this case, the curve-forming forming roll part 11 may be provided with the above-described slide mechanism 20 and tilt mechanism 30.

Accordingly, for example, in the case of manufacturing an elongated component 40 such as an aircraft frame, when an elongated material 41 (e.g., an elongated plate member), which is the raw material of the elongated component 40, is fed from a roll forming apparatus and continuously subjected to multi-stage roll bending, even if the elongated component 40 to be manufactured is made of a different raw material from the previous one or has a varying contour, the elongated component 40 can be formed by the single roll bending apparatus 10 without requiring the use of a plurality of different roll forming apparatuses.

As described above, the roll bending apparatus 10 according to the present disclosure may include: the roll pair 12 formed by the pair of rolls 12*a* and 12*b* disposed facing each other, the roll pair 12 being configured to sandwich the elongated material 41 between the rolls 12*a* and 12*b* to perform forming on the elongated material 41; the slide mechanism 20 configured to slide the roll pair 12 in the first normal direction (the direction normal to the conveying direction F of the elongated material 41); and the tilt mechanism 30 configured to rotate the roll pair 12 about the tilt axis Xt, which extends in the second normal direction (the direction orthogonal to the conveying direction F of the elongated material 41 and the first normal direction). The slide mechanism 20 may be further configured to slide the roll pair 12 to change the position of the roll pair 12 relative to the tilt axis Xt.

According to the above configuration, since the roll bending apparatus 10 includes the slide mechanism 20 and the tilt mechanism 30, not only is the roll pair 12 simply slid, but also the position of the roll pair 12 can be changed relative to the tilt axis Xt. This makes it possible to adjust the position of the roll pair 12 such that the roll pair 12 is positioned orthogonally to the tangent line to the path line. This consequently makes it possible to perform roll forming with a different path line. Therefore, even if the single elongated component 40 has a varying contour or varying cross-sectional rigidity within itself, a curve can be formed therein precisely. As a result, the elongated component 40 having a varying contour or varying cross-sectional rigidity can be manufactured without using, for example, stretch forming or press forming.

In addition, in the case of forming a predefined cross-sectional shape by roll forming and/or roll bending, a curve can be formed by roll bending continuously following the roll forming of forming the cross-sectional shape. Therefore, the elongated component 40 can be manufactured by using substantially the same equipment (jig and/or rolls). This makes it possible to realize significant cost reduction.

From the foregoing description, numerous modifications and other embodiments of the present invention are obvious to a person skilled in the art. Therefore, the foregoing description should be interpreted only as an example and is provided for the purpose of teaching the best mode for carrying out the present invention to a person skilled in the art. The structural and/or functional details may be substantially altered without departing from the spirit of the present invention.

INDUSTRIAL APPLICABILITY

The present invention is widely and suitably applicable in the field of curve forming, in which a curve is formed in an elongated material that has a varying contour or varying cross-sectional rigidity.

REFERENCE SIGNS LIST

10 roll bending apparatus
11 forming roll part
12 roll pair (roll set)
12*a* first roll
12*b* second roll
13 roll drive unit
13*a* first roll driver
13*b* second roll driver
14 first roll support
15 second roll support
16 roll pair support
16*a* fitting portion
17 stand base
20 slide mechanism
21 first slide part
22 second slide part
23 third slide part
30 tilt mechanism
31 tilt axis part
40 elongated component
40*a* constant curve portion
40*b* variable curve portion
41 elongated material
50 bending path
51 roll bending part
52 roll bending part
60 operator

The invention claimed is:

1. A roll bending apparatus comprising:

a stand base;

a tilt axis support that is placed on the stand base and that slides relative to the stand base on a plane including a conveying direction of an elongated material in a first normal direction that is normal to the conveying direction;

a roll pair support disposed on the tilt axis support, such that the roll pair support rotates about a tilt axis that extends in a second normal direction that is orthogonal to both the conveying direction and the first normal direction; and a roll pair that is supported on the roll pair support and that is comprised of a pair of rolls disposed facing each other, the roll pair sandwiching the elongated material between the rolls to perform forming on the elongated material, wherein:

the roll pair includes a first roll and a second roll, and the roll bending apparatus further comprises a first roll support that supports the first roll and that is supported on the roll pair support, the first roll support sliding relative to the roll pair support in the first normal direction.

2. The roll bending apparatus according to claim 1, further comprising a second roll support that supports the second roll and that is supported on the first roll support, the second roll support sliding in the first normal direction relative to the first roll support.

3. The roll bending apparatus according to claim 1, further comprising forming roll parts, wherein one of the forming roll parts includes the roll pair, the forming roll parts being arranged in the conveying direction of the elongated material, wherein at least one of the forming roll parts includes the tilt axis support and the roll pair support.

4. The roll bending apparatus according to claim 3, wherein each of the forming roll parts include:

a cross-sectional-shape-forming roll bending part that roll-forms an elongated plate member that is the elongated material into an elongated component having a predefined cross-sectional shape; and a curve-forming forming roll part that forms a curve in the elongated component that is the elongated material, and the curve-forming forming roll part is provided with the tilt axis support and the roll pair support .

5. A roll bending apparatus comprising:

a stand base;

a tilt axis support that is placed on the stand base and that slides relative to the stand base on a plane including a conveying direction of an elongated material in a first normal direction that is normal to the conveying direction;

a roll pair support disposed on the tilt axis support, such that the roll pair support rotates about a tilt axis that extends in a second normal direction that is orthogonal to both the conveying direction and the first normal direction; and a roll pair that is supported on the roll pair support and that is comprised of a pair of rolls disposed facing each other, the roll pair sandwiching the elongated material between the rolls to perform forming on the elongated material, the pair of rolls including a first roll that includes an upper smaller-diameter portion and a lower larger-diameter portion, and a second roll that includes an upper larger-diameter portion and a lower smaller-diameter portion.

6. A roll bending apparatus comprising:

a stand base;

a tilt axis support that is placed on the stand base and that slides relative to the stand base on a plane including a conveying direction of an elongated material in a first normal direction that is normal to the conveying direction;

a roll pair support disposed on the tilt axis support, such that the roll pair support rotates about a tilt axis that extends in a second normal direction that is orthogonal to both the conveying direction and the first normal direction; and a roll pair that is supported on the roll pair support and that is comprised of a pair of rolls disposed facing each other, the roll pair sandwiching the elongated material between the rolls to perform forming on the elongated material, the pair of rolls including a first roll and a second roll, a rotational axis of the first roll and a rotational axis of the second roll being parallel to each other during forming of the elongated material.

* * * * *